US006389250B1

(12) United States Patent
Numagami et al.

(10) Patent No.: US 6,389,250 B1
(45) Date of Patent: May 14, 2002

(54) DEVELOPING DEVICE, PROCESS CARTRIDGE AND ELECTROPHOTOGRAPHIC IMAGE FORMING APPARATUS

(75) Inventors: Atsushi Numagami, Hadano; Hisayoshi Kojima, Mishima; Kazunari Murayama, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/650,410

(22) Filed: Aug. 29, 2000

(30) Foreign Application Priority Data

Aug. 30, 1999 (JP) ..... 11-243733

(51) Int. Cl.[7] ..... G03G 15/00
(52) U.S. Cl. ..... 399/111; 399/90; 399/119
(58) Field of Search ..... 399/111, 90, 119, 399/125

(56) References Cited

U.S. PATENT DOCUMENTS 5,873,012 A * 2/1999 Miyabe et al. ..... 399/90
5,923,926 A * 7/1999 Isobe et al. ..... 399/119

FOREIGN PATENT DOCUMENTS

JP 09-043925 * 2/1997
JP 2000-075767 * 3/2000

* cited by examiner

*Primary Examiner*—Sophia S. Chen
(74) *Attorney, Agent, or Firm*—Fitzpatrick, Cella, Harper & Scinto

(57) ABSTRACT

A process cartridge datably mountable to a main assembly of an electrophotographic image forming apparatus featuring a connector portion for transmitting a result of detection by a detecting member to a main assembly of the apparatus by electrical connection to the main assembly of the apparatus. A photosensitive member driving force receiving portion, a developing member driving force receiving portion, a developing bias contact and the connector portion are disposed at a leading end of the process cartridge when the process cartridge is mounted to the main assembly of the apparatus. The connector portion and the developing bias contact are disposed with the developing member driving force receiving portion therebetween. The process cartridge is mounted to the main assembly of the apparatus along a longitudinal direction of the developing member.

15 Claims, 30 Drawing Sheets

DEVELOPING DEVICE, PROCESS CARTRIDGE AND ELECTROPHOTOGRAPHIC IMAGE FORMING APPARATUS

FIELD OF THE INVENTION AND RELATED ART

The present invention relates to an electrophotographic image forming apparatus, a developing device which is detachably mountable to a main assembly thereof and a process cartridge which is detachably mountable to the main assembly.

Here, the electrophotographic image forming apparatus is an apparatus forming an image on a recording material using an electrophotographic image formation process. Examples of the electrophotographic image forming apparatus include an electrophotographic copying machine, an electrophotographic printer (a laser beam printer, LED printer or the like), a facsimile machine and a word processor.

The process cartridge may be a cartridge which contains as a unit an electrophotographic photosensitive drum and charging means, developing means or cleaning means and which is detachably mountable to the main assembly of the image forming apparatus. The process cartridge may be a cartridge which contains as a unit an electrophotographic photosensitive drum and at least one of charging means, developing means and cleaning means and which is detachably mountable to the main assembly of the image forming apparatus. The process cartridge may be a cartridge which contains as a unit an electrophotographic photosensitive drum and developing means and which is detachably mountable to the main assembly of the image forming apparatus.

In an image forming apparatus using an electrophotographic image process, such a process cartridge is used. This is because the maintenance of the apparatus can be carried out in effect by the user without the serviceman, so that operativity is remarkably improved. Therefore, the process cartridge type is widely used in the field of the image forming apparatus.

Also widely used is a developing device in the form of a cartridge which contains as a unit developing means and a toner container accommodating toner to be supplied into the developing means and to which is detachably mountable to the main assembly of an image forming apparatus.

Where the developer used in the developing device or the process cartridge is two component developer, there is provided detecting means for detecting a mixing ratio of the toner and the carrier. The developing means is supplied with a DC voltage and an AC voltage.

The developing device or the process cartridge is supplied from the main assembly with a driving force for driving the photosensitive drum and the developing means therein.

The present invention provides a further development of such technique.

SUMMARY OF THE INVENTION

It is a principal object of the present invention to provide a process cartridge, a developing device and an electrophotographic image forming apparatus wherein the mounting-and-demounting operativity of the process cartridge relative to the main assembly of the apparatus is improved.

It is another object of the present intention to provide a process cartridge, a developing device and an electrophotographic image forming apparatus wherein a connector part is substantially free of electrical influence.

It is a further object of the present invention to provide a process cartridge, a developing device and an electrophotographic image forming apparatus wherein the mounting-and-demounting operativity of the process cartridge relative to the main assembly of the apparatus is improved and wherein a connector part between the main assembly of the apparatus, and a detecting member for detecting a mixing ratio of the toner and the carrier is not influenced by a high AC voltage applied to a developing member, so that operation is stabilized. It is a further object of the present invention to provide a process cartridge and a developing device wherein a connector part, a developing member drive receiving portion and a developing bias contact are arranged efficiently, and an electrophotographic image forming apparatus to which the process cartridge or the developing device is detachably mountable. According to an aspect of the presentation, there is provided a process cartridge, a developing device and an electrophotographic image forming apparatus to which the process cartridge or the developing device is detachably mountable, wherein the connector part and the developing bias contact are disposed with a developing member driving force receiving portion therebetween.

According to another aspect of the present invention, there is provided an electrophotographic image forming apparatus wherein said connector portion, said developing member driving force receiving portion and said developing bias contact are arranged such that they are positioned in this order from a top side to a bottom side of the process cartridge, when said process cartridge is mounted to the main assembly of the apparatus.

These and other objects, features and advantages of the present invention will become more apparent upon a consideration of the following description of the preferred embodiments of the present invention taken in conjunction with the accompanying drawings.

DESCRIPTION OF THE PREFERRED EMODIMENTS

Figure 1:
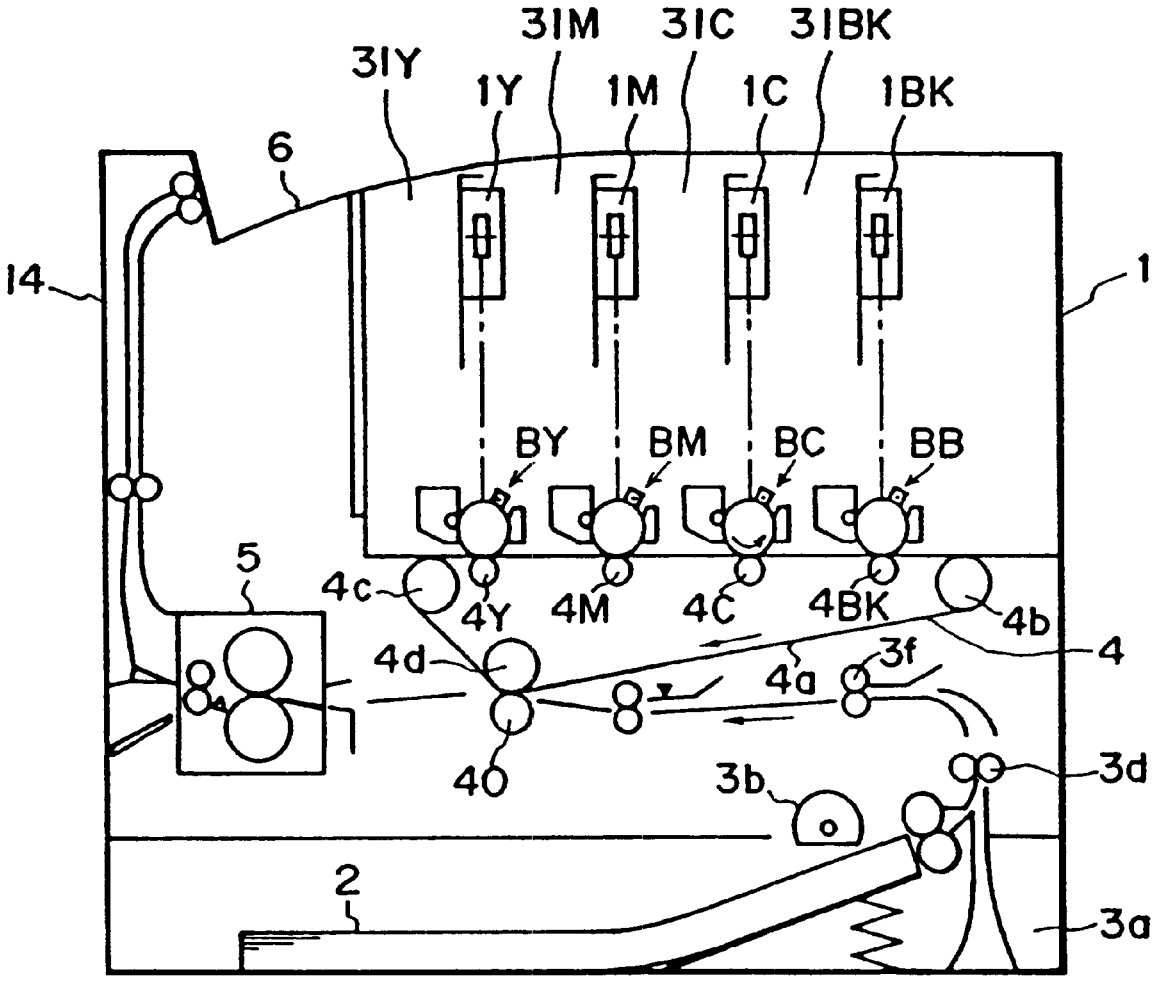
FIG. 1 is a longitudinal sectional view of an electrophotographic image forming apparatus.

A description will be made as to the embodiments of the present invention in conjunction with the accompanying drawings.

First, the embodiments of the present invention will be described briefly. A process cartridge includes an electrophotographic photosensitive drum which is supported for rotation not interrelated with the process means and which is provided with a coupling for engagement with and disengagement from a coupling provided in a main assembly of the apparatus when the process cartridge is mounted to or demounted from the main assembly of the apparatus in a longitudinal direction of the process cartridge, and developing means actable on the electrophotographic photosensitive drum, and the developing means is driven by the main assembly of the apparatus through a coupling which is different from a drive transmission means for the electrophotographic photosensitive drum. The coupling for driving the developing means is disposed on the such an end as has a coupling for driving the electrophotographic photosensitive drum, and is engaged with or disengaged from a coupling of the main assembly of the image forming apparatus when the process cartridge is mounted to or demounted from the main assembly of the apparatus in the longitudinal direction of the process cartridge.

A contact portion for contact to the main assembly of the apparatus to apply a DC voltage and an AC voltage to the developing means is disposed on the same end as the coupling portion for driving the electrophotographic photosensitive drum and the coupling for driving the developing means. The developing device is provided with detecting means for detecting a mixing ratio of toner and a carrier in a two component developer (the detecting means is called toner content detecting means), and a connector portion of the toner content detecting means relative to the main assembly of the apparatus is disposed on the same end as the coupling for driving the developing means and the coupling portion for driving the electrophotographic photosensitive drum.

The coupling for driving the developing means or the coupling for driving the electrophotographic photosensitive drum, the electric power supply contact portion for the developing means and the connector portion of the toner content detecting means for contact to the main assembly of the apparatus, is disposed at a leading end of the process cartridge when the process cartridge is mounted to the main assembly of the apparatus in the longitudinal direction, by which the mounting-and-demounting operativity of the process cartridge relative to the main assembly of the apparatus, so that drive transmission mechanism is simplified the connection of the connectors and the connection of the contacts are easy and assured.

The electric power supply contact portion for the developing means and the connector portion for the toner content detecting means is disposed with the coupling for driving the developing means therebetween, by which the influence of the high voltage AC voltage at the electric power supply contact portion of the developing means is prevented from extending to the connector portion for the toner content detecting means, so that toner content can be stably detected.

The same applies to a developing device which is detachably mountable to the main assembly of the apparatus and which has developing means and toner content detecting means for the developer to be supplied to the developing means.

In the following descriptions, the longitudinal direction is a direction parallel with a recording material and crossing with a feeding direction of the recording material. The left and right means left and right as seen in the feeding direction of the recording material. Upper or top of the process cartridge is determined in the state in which the process cartridge is mounted to the main assembly of the apparatus.

FIG. 1 shows an image forming apparatus 1 according to an embodiment of the present invention. The image forming apparatus 1 comprises image formation stations 31Y, 31M, 31C, 31BK for forming a toner image on a photosensitive drum (image bearing member), an intermediary transfer belt 4*a* for temporarily carrying the toner image, a secondary transfer roller 40 (transferring means) for transferring the toner image from the belt 4*a* onto the recording material 2, sheet feeding means for feeding the recording material 2 into between the intermediary transfer belt 4*a* and the secondary transfer roller 40, feeding means for feeding the recording material 2 to the transferring means, fixing means and sheet discharging means.

A description will be made as to image formation.

As shown in the Figure, the main assembly of the image forming apparatus 1 is provided with a detachably mountable sheet feeding cassette 3*a* for stacking a plurality of recording materials (recording paper, OHP sheet, textile or the like).

The recording material 2 is fed out of the sheet feeding cassette 3*a* by a pick-up roller 3*b* and a pair of retarding rollers, and is fed to a pair of registration rollers by feeding rollers 3*d*, 3*f*.

When the recording material 2 comes to the registration rollers, the registration rollers are not rotated, and the inclination of the recording material 2 is corrected by abutment to the nip formed between the rollers.

In the case of a four-drum full-color type, the process cartridges BY, BM, BC, BB contenting image bearing members, respectively are juxtaposed as shown in the Figure, the process cartridges BY, BM, BC, BB being for yellow, magenta, cyan and black colors. For each of the process cartridges BY, BM, BC, BB, a scanning optical system 1Y, 1M, 1C, 1BK is provided, and a toner image is formed on the associated photosensitive drum in accordance with an image signal for the color, and thereafter, the tone images formed thereby are transferred superimposedly transferred by the transfer rollers 4 (4Y, 4M, 4C and 4BK) onto the intermediary transfer belt 4*a* which is traveling in the direction indicated by the arrow.

Thereafter, the recording material 2 is fed to the secondary transfer roller 40 at a predetermined timing, and the toner image on the intermediary transfer belt 4*a* is transfer tone to the recording material 2. The toner image is fixed by a fixing device 5, and is thereafter discharged by a pair of discharging rollers and is stacked on a tray 6 of the main assembly 14 of apparatus.

The image formation stations 31Y, 31M, 31C, 31BK are in the form of respective process cartridges B (BY, BM, BC, BB). These process cartridges have substantially the same structure, and therefore, the description will be made as to the process cartridge BY.

Figure 2:
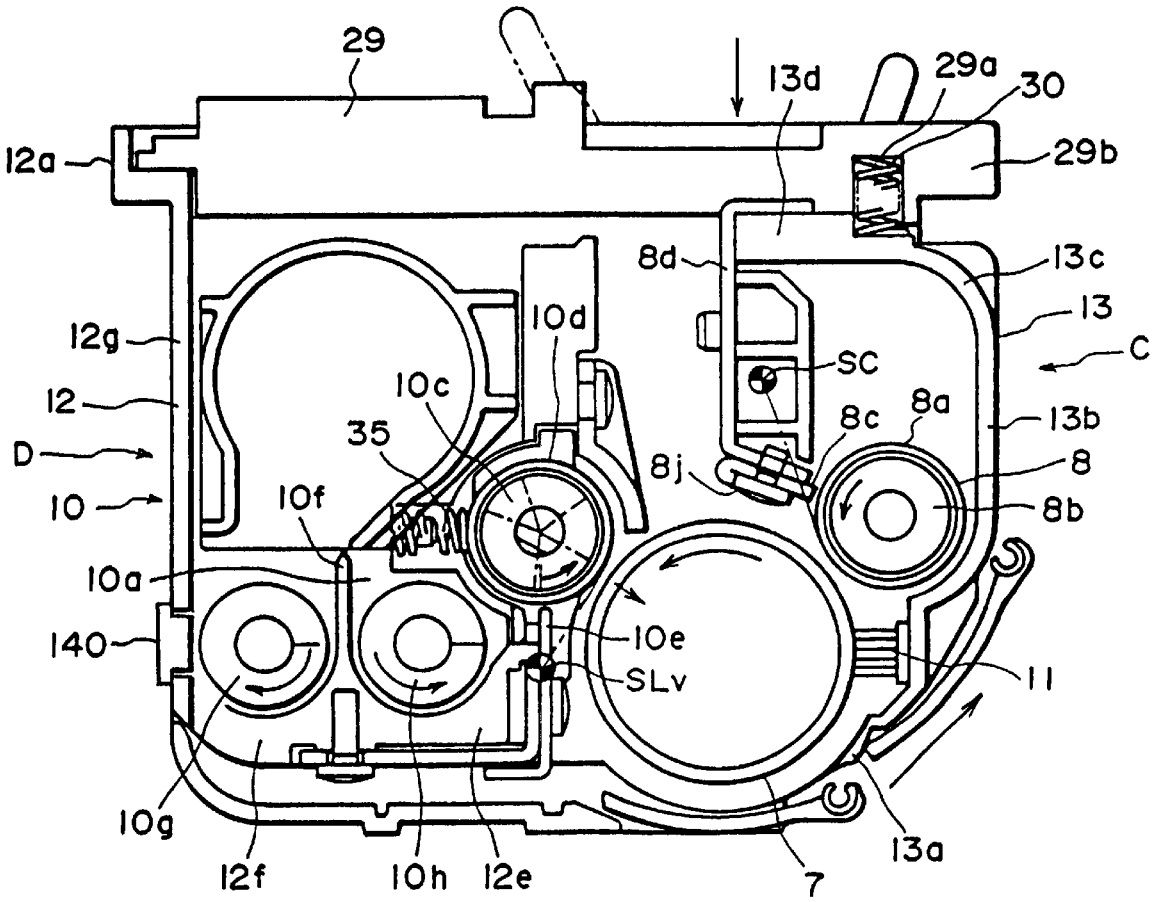
FIG. 2 is a longitudinal sectional view of a process cartridge.

As shown in FIG. 2, the process cartridge BY contains the photosensitive drum 7, the charging means, the exposed portion, the developing means, and the transfer opening. In this embodiment, the two component developer is used and which comprises magnetic carrier powder. In this embodiment, the photosensitive drum 7 may be a normal organic photosensitive member.

In this embodiment, the photosensitive drum 7 comprises a drum base member of aluminum and a negative charging organic photosensitive member thereon.

The charging means is a magnetic brush charger 8 using magnetic carrier particles.

The charger 8 comprises a charging roller 8*a* of hollow cylindrical shape which is rotatably supported, and a fixed magnet 8*b* therein. After the image transfer, the toner remaining on the photosensitive drum 7 is caught by the charger 8 which is rotating in the direction indicated by the arrow in the Figure.

The developing means is a type in which two component developer is contacted to the photosensitive member (two component non-contact type development) in this embodiment.

FIG. 2 shows a developing means 10 for the two component magnetic brush development use in this embodiment. The developing sleeve 10*d* is hollow, cylindrical, and rotatably supported. In the developing sleeve 10*d,* there is provided a stationary magnet 10*c*. The developing sleeve 10*d* rotates in the same direction as the photosensitive drum 7, therefore, the peripheral surface thereof is moved to think the direction opposite from the direction of the movement of the peripheral surface of the photosensitive drum 7. The photosensitive drum 7 and the developing sleeve 10*d* are out of contact from each other with a gap of approximately 0.2–1.0 mm. With this gap, the developing action is carried out with the developer contacted to the photosensitive drum 7.

The toner mixed with the carrier particles is supplied by stirring screws provided in the casing partitioned by a longitudinal partition 10*f* which it extended except for the longitudinal end portions. The toner supplied from an unshown toner supply container falls to one end side of the stirring screw 10*g,* and is fed in one longitudinal direction while being stirred, and is moved through the other end portion which is not provided with the partition 10*f* to the one end portion by the stirring screw 10*h*. Then, it is fled to the stirring screw 10*h* through the one end portion without the partition 10*f,* thus circulating.

Figure 7:
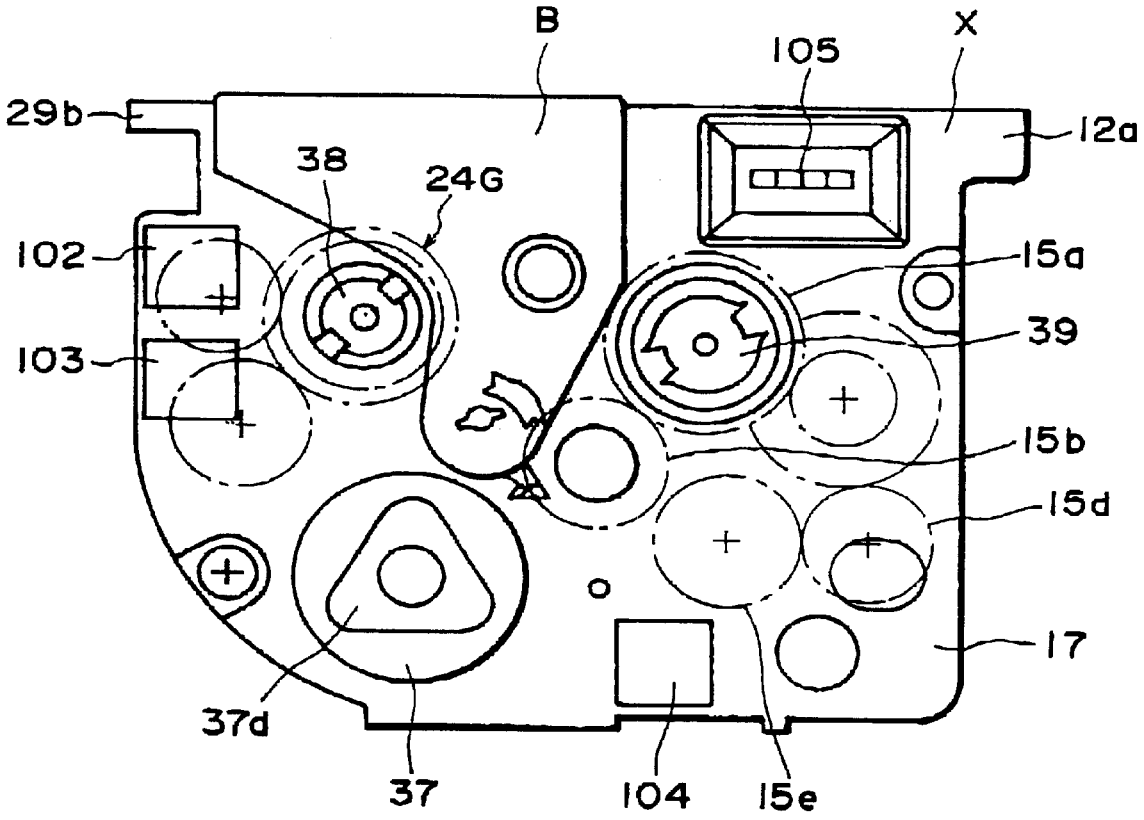
FIG. 7 is a rear view of a process cartridge.

In this embodiment, the mixture ratio of the carrier particles and the toner particles is always detected, and the toner is supplied from the toner supply container (unshown) in response to the consumption of the toner such that the mixture ratio is constant. A toner content detecting means 140 for detecting the toner content of such a toner density control mechanism for controlling the toner density is disposed adjacent the stirring screw in the developer container (FIG. 2). The connection between the toner content detecting means 140 and the main assembly 14 of the apparatus established by the toner density control connector 105 and a connector 131 (FIG. 33) as shown in FIG. 7. The toner content detecting means 140 functions to detect the mixture ratio of the toner and the carrier of the developer in the developer container 10*a* provided with the stirring screw log in this embodiment.

A description will be made as to the developing process in which the electrostatic latent image formed on the photosensitive drum 7 through the two component magnetic brush method into a visualized image and as to the circulating system for the developer. The developer is taken up by a magnetic pole of a magnet 10*c* with rotation of the developing sleeve 10*d,* and is regulated by a food regulating blade 10*e* (developing blade) extended to perpendicularly to the surface of the developing sleeve 10*d* with, into a thin layer of the developer on the developing sleeve 10*d*. When the developer in the formal the thin layer reaches the main developing pole, a brush of the developer is formed by the magnetic force. The electrostatic latent image on the photosensitive drum 7 is developed by the brush of the developer, and then, the developer on the developing sleeve 10*d* is returned into the developing container 10*a* by repelling magnetic field.

The developing sleeve 10*d* is supplied with a DC voltage and an AC voltage from an unshown voltage source. Generally, in a two component developing method, when an AC voltage is applied, the development efficiency is improved so that image quality is improved, but correspondingly, fog tends to be produced. For this reason, by providing a potential difference between the DC voltage applied to the developing sleeve 10*d* and the surface potential of the photosensitive drum 7, the toner deposition onto the nonimage region during the developing operation is prevented. The electric energy supply from the main assembly 14 of the apparatus to the process cartridge B is effected by the contact between a developing bias contact 104 of the process cartridge shown in FIG. 7 and a developing bias contact 130 of the main assembly shown in FIG. 33.

The toner image is transfer onto the intermediary transfer belt 4*a* by an intermediary transferring device 4. The intermediary transferring device 4 comprises an endless belt 4*a* extended around a driving roller 4*b,* a follower roller 4*c* and a secondary transfer opposing roller 4*d,* and the belt 4*a* is rotated in the direction indicated by the arrow in FIG. 1. In the area defined by the circumferential travel of the transfer belt 4*a,* there are provided transfer charging rollers 4Y, 4M, 4C, 4BK, and each of the transfer charging rollers urges the belt 4*a* at the inside thereof toward the photosensitive drum 7 and is supplied with a voltage from a high voltage source. By this, the electric charge of the polarity opposites from the polarity of the toner is applied to the backside of the belt, by which the toner image is sequentially transferred from the photosensitive drum 7 onto the top surface of the intermediary transfer belt 4*a*.

The material of the intermediary transfer belt 4*a* may be a polyimide resin material. Other examples of the materials of the belt 4*a* include a dielectric member such as a plastic resin material such as polycarbonate resin material, polyethylene terephthalate resin material, polyvinylidene fluoride, polyethylenenaphthalate resin material, polyetheretherketone resin material, polyether sulfone resin material, polyurethane resin material or the like, and a rubber material such as fluorine or silicone rubber.

On the surface of the photosensitive drum 7 after the toner image transfer, residual toner remains. In the residual toner passes by the charger, the charged potential is insufficient only at the after-image portion, or the density of the next image is low or high only in the previous image area (ghost image). Even if the residual toner passes under the charging magnetic brush contacted to the photosensitive drum 7, the configuration of the previous image remains. Therefore, it is desirable to take the residual toner out of the photosensitive drum into the magnetic brush charger 8 in the charging region to remove the hysteresis of the previous image. Here, the residual toner on the photosensitive drum 7 is charged to the positive and negative polarities due to the separation discharge during the transfer operation or the like. From the standpoint of the easiness of the taking the residual toner into the magnetic brush charger 8, the residual toner is desirably charged to the positive polarity.

In this embodiment, an electroconductive brush 11 is contacted to the photosensitive drum 7 at a position between the intermediary transferring device 4 and the magnetic brush charger 8 to apply a bias voltage having a polarity opposite of the charging bias voltage. Residual toner having the positive polarity is passed by the magnetic brush charger 8, whereas the residual toner having the negative polarity is tentatively caught by the electroconductive brush 11, and is electrically discharged and then is returned onto the photosensitive drum 7. By doing so, the residual toner is more easily taken by the magnetic brush. (Structure of a frame of a process cartridge).

The process cartridge B comprises a developing unit D including a developing frame 12 supporting an electrophotographic photosensitive drum 7 and a developing means 10 as a unit, and a charging unit C including a charging frame 13 supporting a charging roller 8*a*, a regulating blade 8*c*, a charging brush 11 and so on as a unit. The developing unit D and the charging unit C are correctly positioned relative to each other and are coupled by a front part cover 16 and a rear part cover 17 (FIG. 4) at the opposite longitudinal ends.

Figure 3:
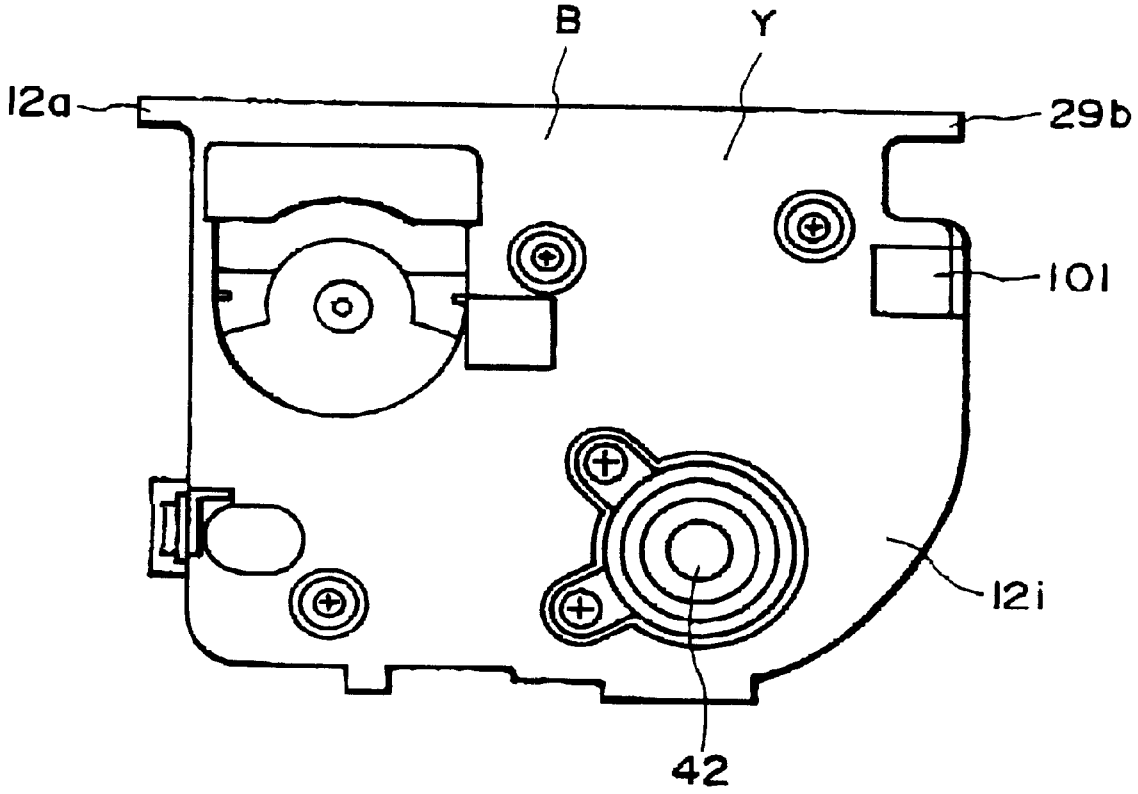
FIG. 3 is a front view of a process cartridge.
Figure 4:
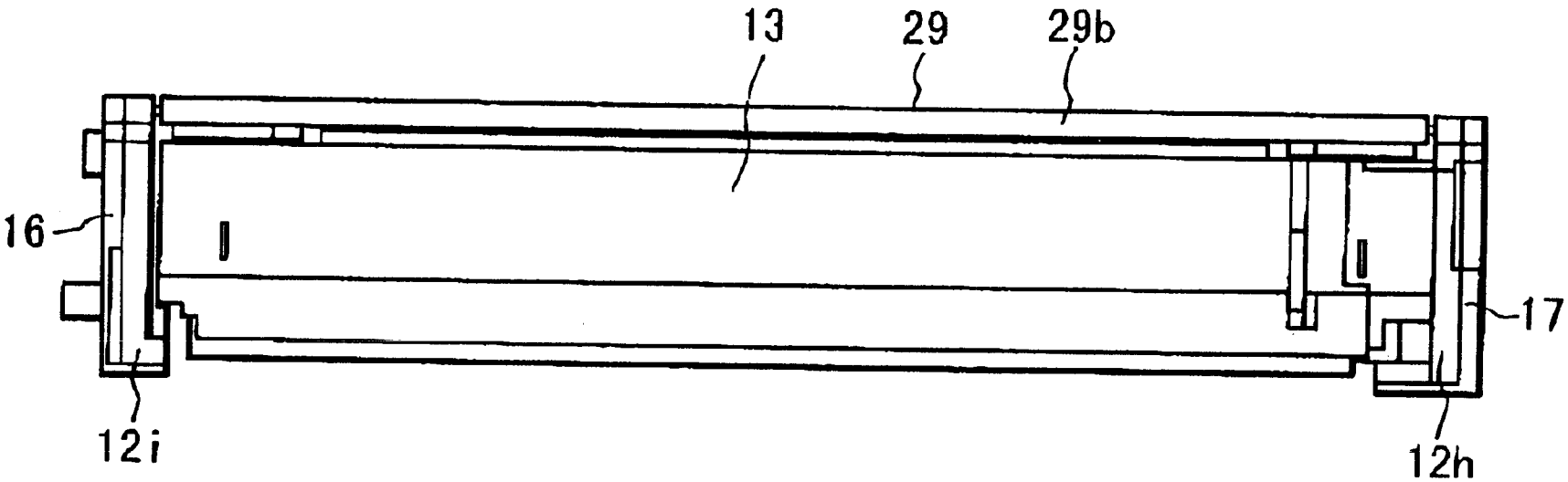
FIG. 4 is a right side view of a process cartridge.
Figure 5:
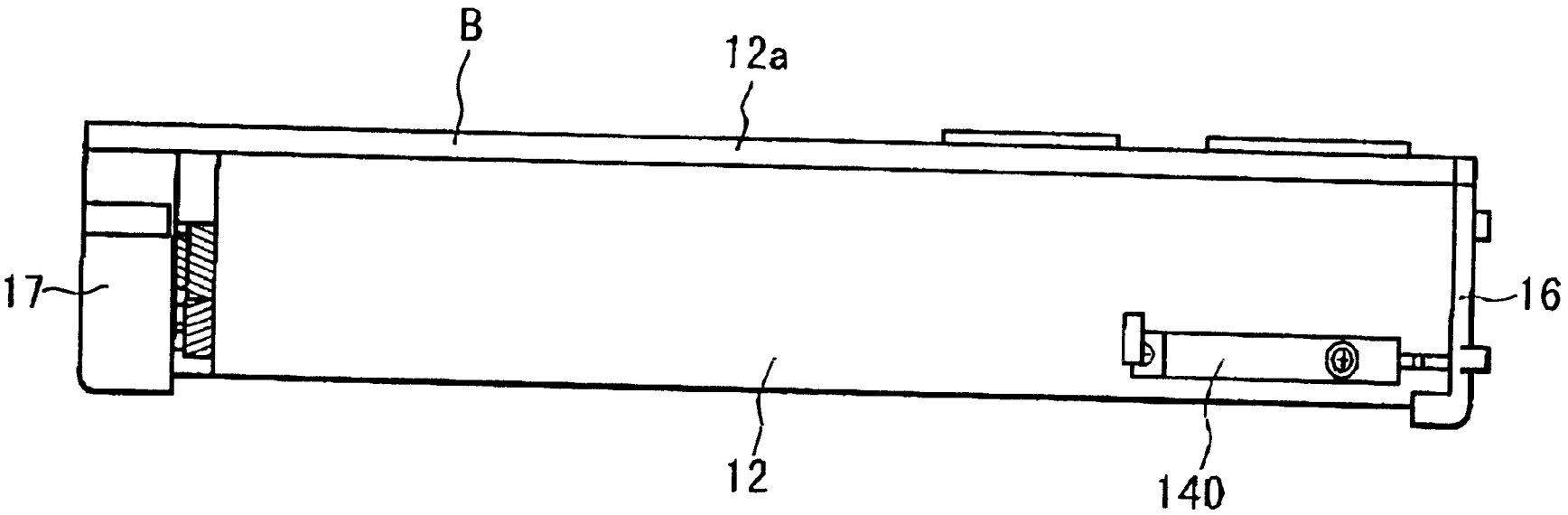
FIG. 5 is a left side view of a process cartridge.
Figure 6:
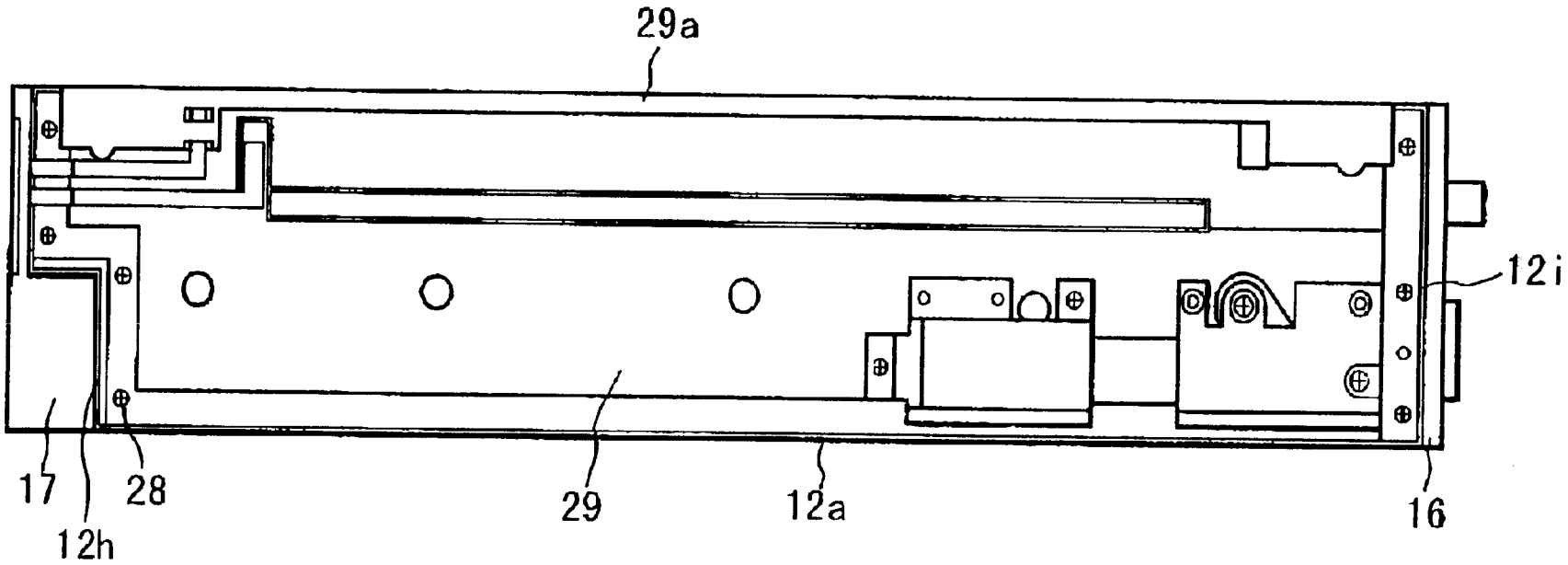
FIG. 6 is a top plan view of a process cartridge.
Figure 8:
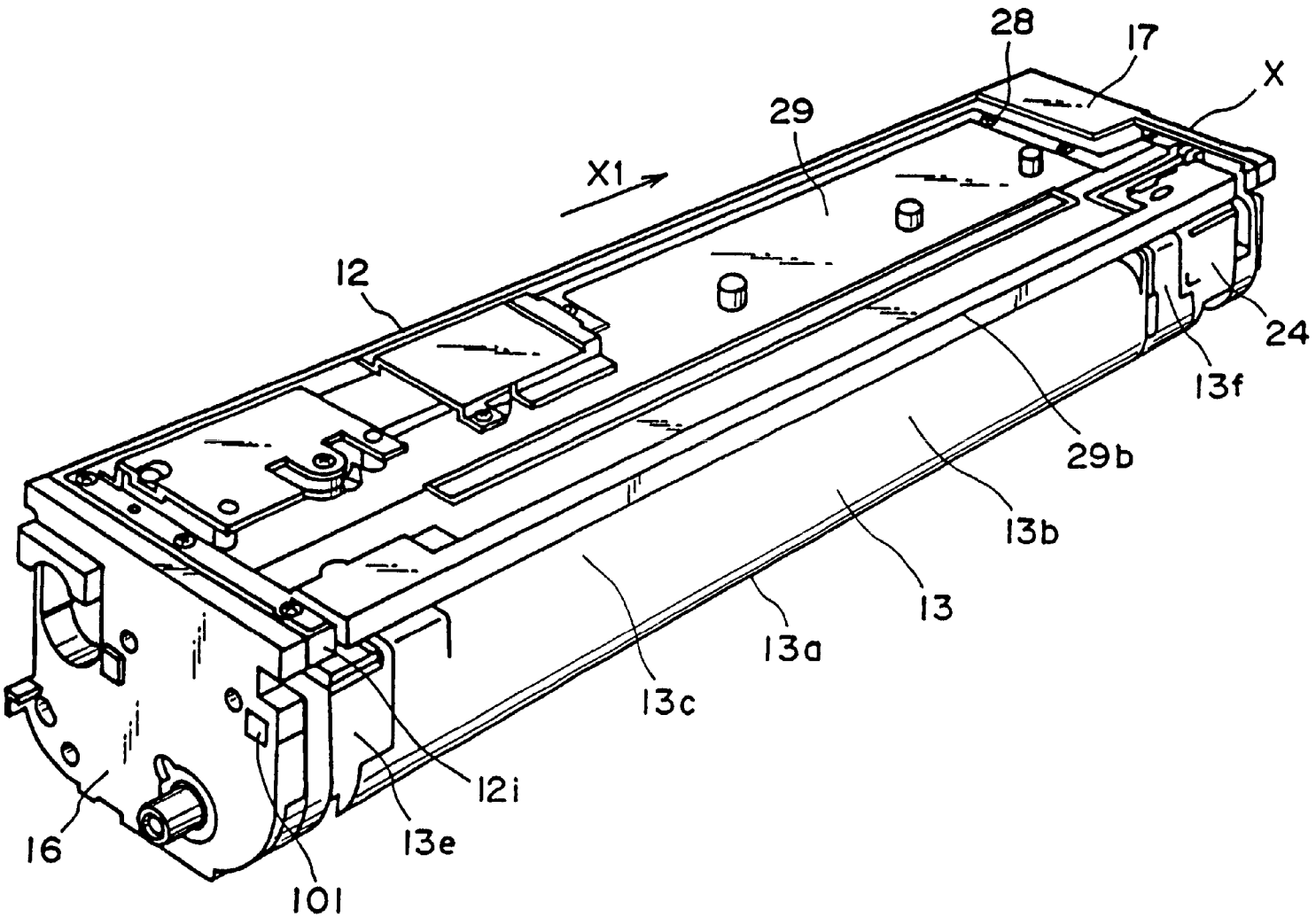
FIG. 8 is a perspective view of a process cartridge as seen from a front right side.
Figure 9:
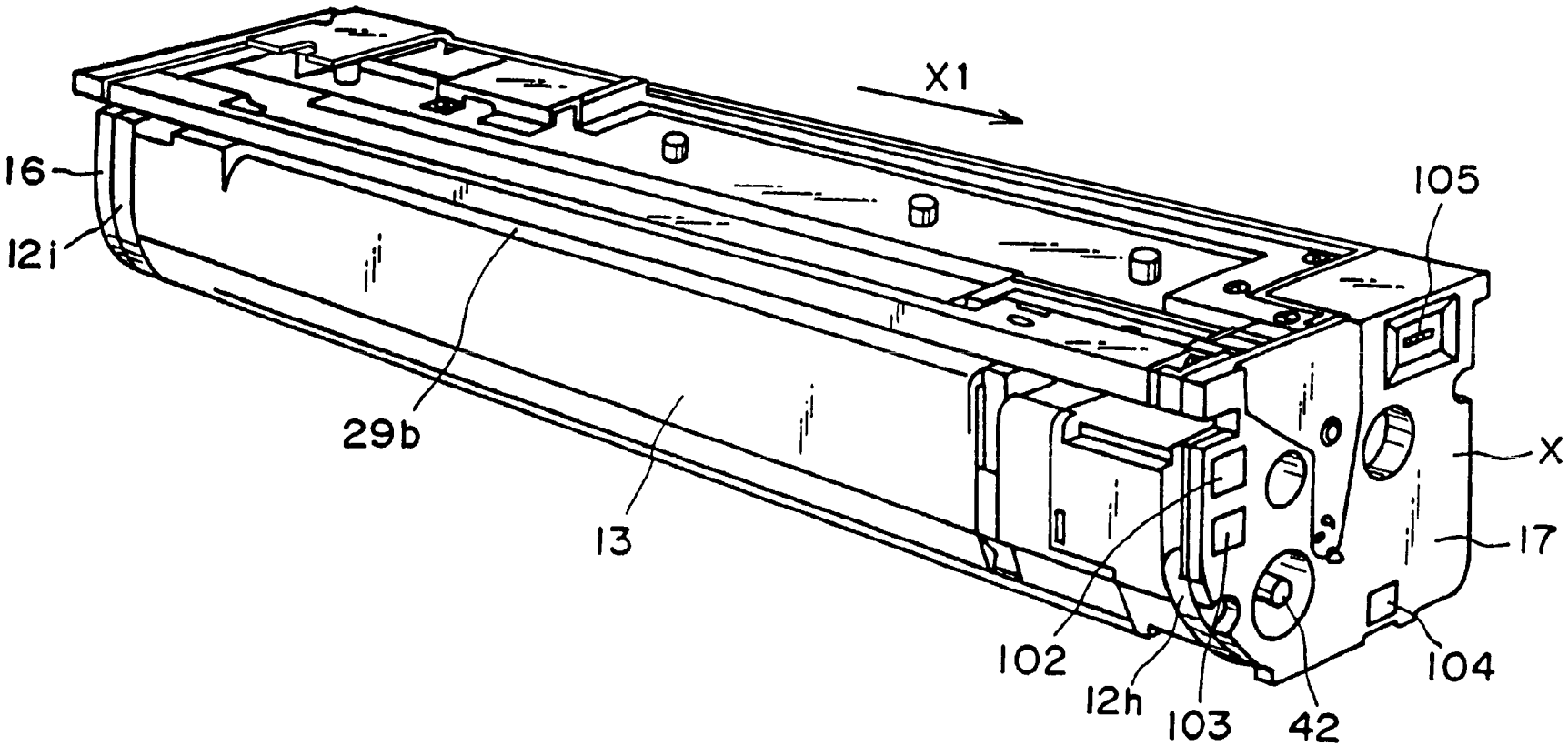
FIG. 9 is a perspective view of a process cartridge as seen from a rear left side.
Figure 10:
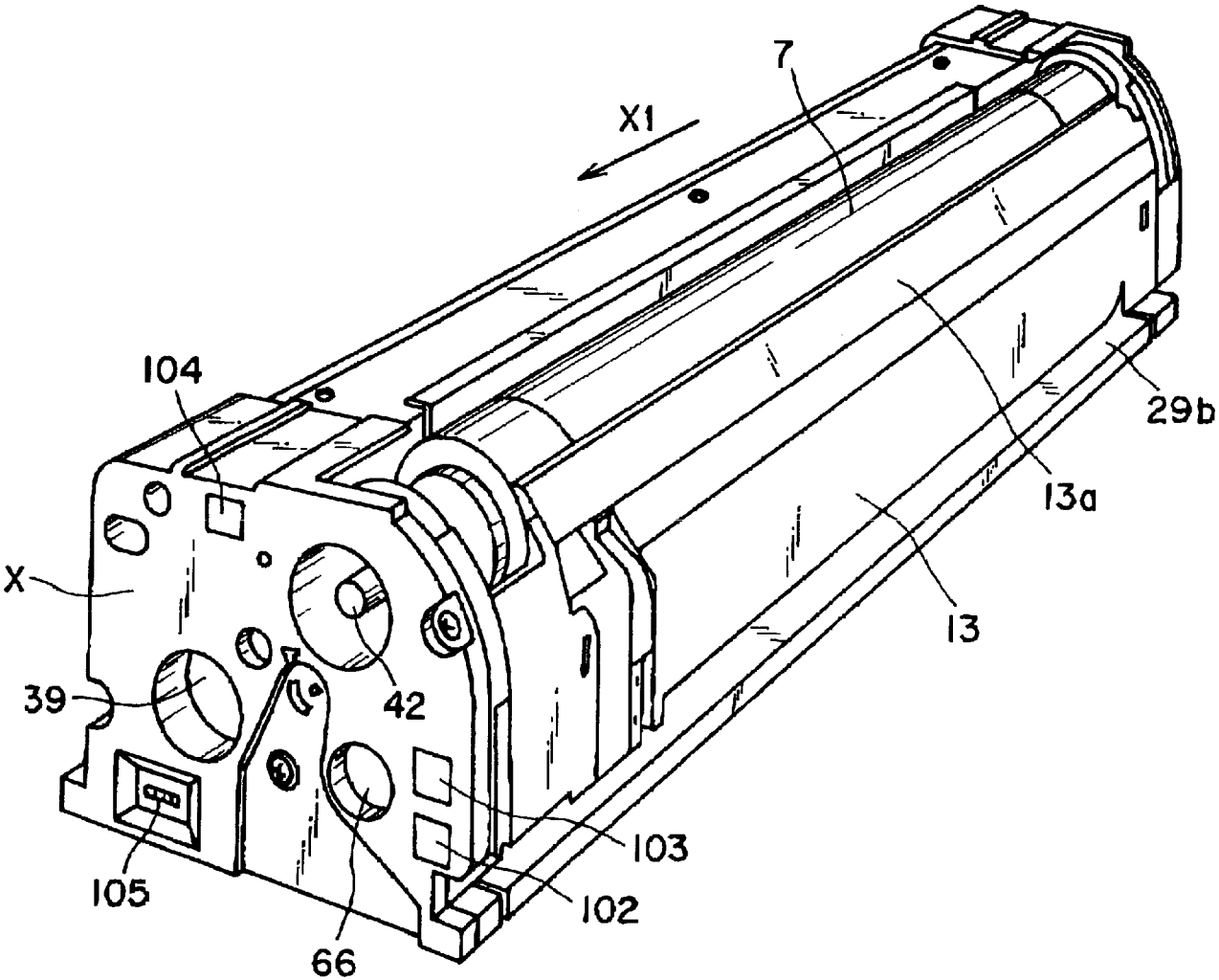
FIG. 10 is a perspective view of a process cartridge which is turned over, as seen from rear side.

FIG. 3 to FIG. 7 are projected Figures of the process cartridge B (BY, SM, BC, BB). More particularly, FIG. 3 is a front view, FIG. 4 is a right side view, FIG. 5 is a left side view, FIG. 6 is a top plan view and FIG. 7 is a rear view. FIG. 8 to FIG. 10 is a perspective view of an outer appearance of a process cartridge B. More particularly, FIG. 8 is a perspective view as seen from the front side, FIG. 9 is a perspective view as seen from the rear side, and FIG. 10 is a perspective view as seen from the rear side when the process cartridge is turned over.

As shown in FIG. 2, the charging unit C comprises a charging roller 8*a*, a regulating blade 8*c*, an electroconductive brush 11 and a charging frame 13 supporting them into a unit. As shown in FIGS. 2, 4, 8, 9, 10, the charging frame 13 constitutes a part of an outer casing of the process cartridge B. The lower edge 13*a* of the charging frame 13, as shown in FIGS. 2, 10, extends parallel with the longitudinal direction of the photosensitive drum 7 with a small gap therefrom. A vertical wall 13*b* is extended from the lower edge 13*a* and constitutes the outer casing, and is curved at the top portion to form a corner portion 13*c*. From the corner portion 13*c*, it extends substantially in the horizontal direction to constitute a top plate portion 13*d* to form a hook shape. Below the top plate portion 13*d*, there is provided a space. At each of the opposite longitudinal ends, there are provided a member mounting portion 13*e*, 13*f*, integrally therewith.

Figure 11:
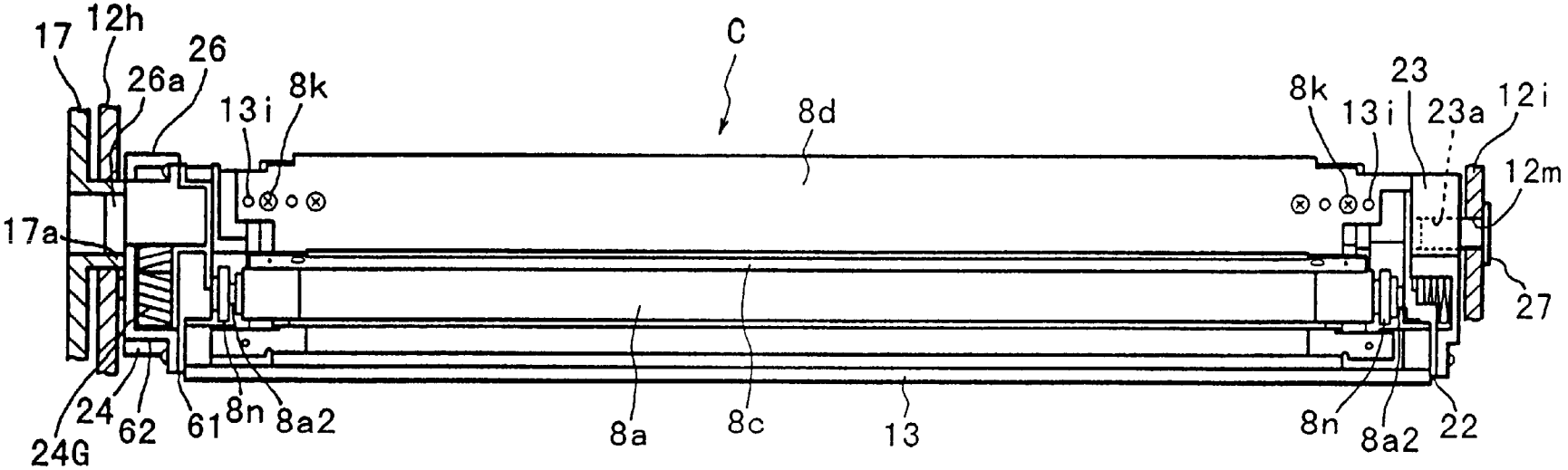
FIG. 11 is a front view of a charging unit.

FIG. 11 is a side view of the charging unit C has seen from the inside thereof. At the one of the front side ends, with respect to the mounting direction of the process cartridge 3 of the charging frame 13 (the cartridge is mounted in the longitudinal direction from the front side of the main assembly 14 of the apparatus), the charging roller bearing 22 and the end cover 23 are fastened. At the other end, a gear unit 24 is fastened by screwed.

Figure 12:
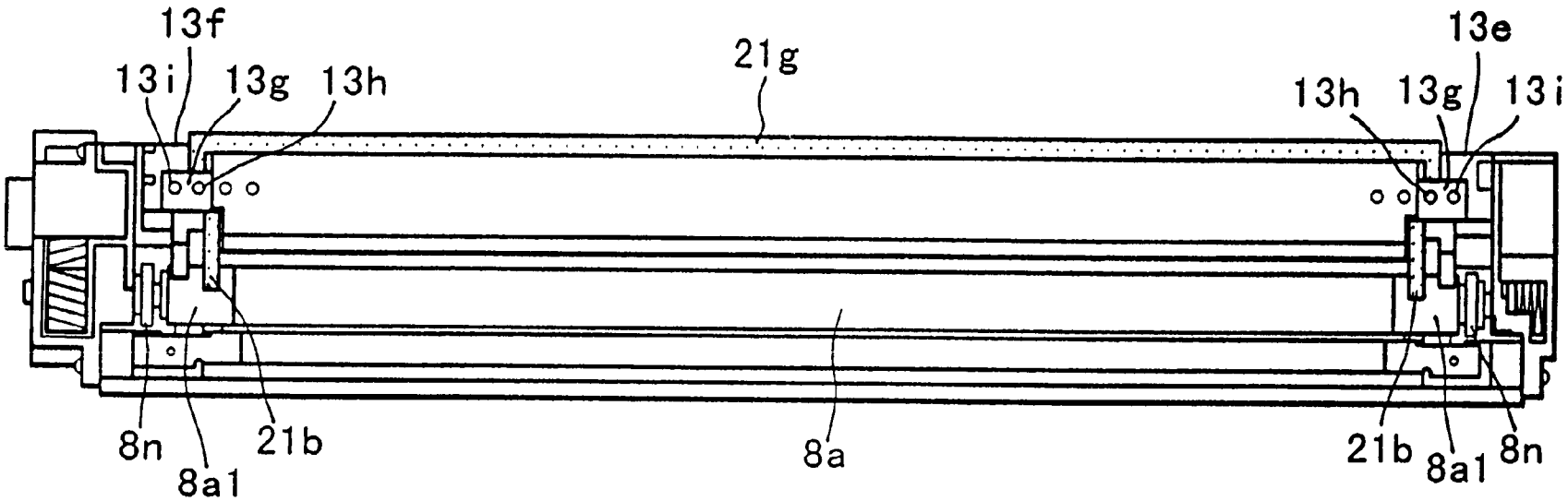
FIG. 12 is a front view of a charging unit of FIG. 11 with a blade thereof removed.

FIG. 12 is a side view of the charging unit C from the inside thereof with the regulating blade 8*c* and the supporting metal plate 8*d* omitted. A blade mounting seat portion 13*g* is provided as a stepped-up portion of the member mounting portion 13*e*, 13*f* is provided with a threaded hole 13*h* and a dowel 13*i* in a surface to which respective opposite ends of the regulating blade 8*c* are contacted, as shown in FIG. 12. To a surface retracted from the 13*g*, a sealing material 21*g* in the form of a sponge, for example, is adhered and extended in the longitudinal direction. A sealing material 21*b* in the form of a felt for example is adhered on the seal portion 8*a*1 at each of the opposite ends of the charging roller 8*a* and is extended in the circumferential direction to prevent the leakage of the developer in the axial direction. Theretofore, the proton of the charging frame 13 opposed to the seal portion 8*a*1 at each of the opposite ends of the charging roller 8*a* is arcuate concentrically with the charging roller 8*a*.

The regulating blade 8*c* of metal, as shown in FIG. 2, is spaced from the charging roller 8*a* with a gap there between and is fastened to the supporting metal plate 8*d* by small screws 8*j*. The supporting metal plate 8d has a groove shape section and is engaged into the dowel 13*i* formed in the seat portion of the charging frame 13, and small screws 8*k* are threaded into the threaded holes 13*h* of the seat portion 13*g*: by which the supporting metal plate 8*d* and the seat portion are abutted to each other, and a sealing material is compressed by the supporting metal plate 8*d*. In addition, a neighborhood of the seat portion of the sealing material 21*b* is compressed by the supporting metal plate 8*d*. The supporting metal plate 8d has a very high rigidity, so that with the rigidity of the charging frame 13 is enhanced by fixing the opposite ends therefrom the charging frame 13.

(Mounting of the Charging Unit)

The charging unit C is swingably supported to the developing frame 12 for pivotable movement about a center SC as shown in FIG. 2. As shown in FIG. 11, a gear case 26 of a gear unit 24 fixed to a rear end (longitudinal direction) of the charging frame 13 is provided with a cylindrical shaft portion 26*a* at the pivotal center SC, and the other end is provided with a cylindrical hole 23*a* at the pivotal center SC on the end cover 23.

As shown in FIG. 2, the developing frame 12 comprises a lower portion 12*f* which accommodates the above described stirring screws 10*g*, 10*h* at respective sides of a partition 10*f* and which is provided with a seat portion 12*e* for mounting the regulating blade 10*e*, a side 12*g* which constitutes a left outer casing as seen in the mounting direction of the process cartridge B, and an end plate portion 12*h* (rear side) and 12*i* (front side) as shown in FIGS. 13, 14, 17, 18 at the opposite longitudinal ends. One end plate portion 12*h* has a hole 12*j* for rotation of the cylindrical shaft portion 26*a* of the charging unit C through a bearing. The other end plate portion 12*i* has a hole 12*m* having the same diameter as the hole 23*a* of the charging frame 13. With the cylindrical shaft portion 26*a* of the charging unit C inserted in the hole 12*j* of the end plate portion 12*h* of the developing frame 12, the cylindrical engagement hole 23*a* of the charging unit C is aligned with the hole 12*m* of the end plate portion 12*i* of the developing frame 12. Then, the rear cover 17 (as seen in the mounting direction of the process cartridge B) is aligned with the end of the developing frame 12, by which an outer periphery of the hollow cylindrical support portion 17*a* (FIGS. 11, 15) projected in the longitudinal direction in the rear cover 17 is engaged into the hole 12*j* of the developing frame 12 and simultaneously therewith, the inner surface thereof is engaged with the cylindrical shaft portion 26*a* of the charging unit C. Additionally, a supporting shaft 27 engaged with and projected through the hole 12*m* formed in the end plate portion 12*i* of the developing frame 12 (FIGS. 11, 14) is engaged with the hole 23*a* of the charging unit C. By doing so, the cylindrical shaft portion 26*a* of the charging unit C at one end is rotatably supported by the end cover 17, and the hole 23*a* at the other end is rotatably supported by the developing frame 12.

As shown in FIGS. 6, 8, at an upper portion of the developing frame 12, a top plate 29 is fixed by ultrasonic welding with the periphery thereof is abutted to the inside of the end plate portions 12*h*, 12*i* of the upper guide portion 12*a*. It may be detachably fastened thereto using small screws 28.

As shown in FIG. 2, the top plate 29 is provided with a spring seat 29*a* at each of two positions which are different in the longitudinal direction. A coil spring 30 supported by the spring seats 29*a* is compressed between the top plate 29 and the charging frame 13. The charging unit C is urged in the clockwise direction about the center SC by the spring force of the spring 30, as seen in FIG. 2.

As shown in FIG. 11, the end of the charging roller 8*a* is reduced in diameter, and the spacer rollers 8*n* are rotatably provided at the journal portion 8*a*2 formed around the rotational center. The spacer rollers 8*n* are press contacted to the photosensitive drum 7 by the spring force of the coil springs 30 outside an image region. With such a structure, there is provided a gap between the photosensitive drum 7 and the charging roller 8*a*, and the residual toner which is going to pass in the portion where the charging roller 8*a* and in the photosensitive drum 7 are opposed to each other, is trapped by the peripheral surface of the charging roller 8a which is moved in the direction opposite from the moving direction of the peripheral surface of the photosensitive drum 7 and which is supplied with a charging bias.

A line connecting the pivotal center SC and the center of the charging roller 8*a* is substantially perpendicular to a line connecting the centers of the charging roller 8*a* and the photosensitive drum 7.

Figure 17:
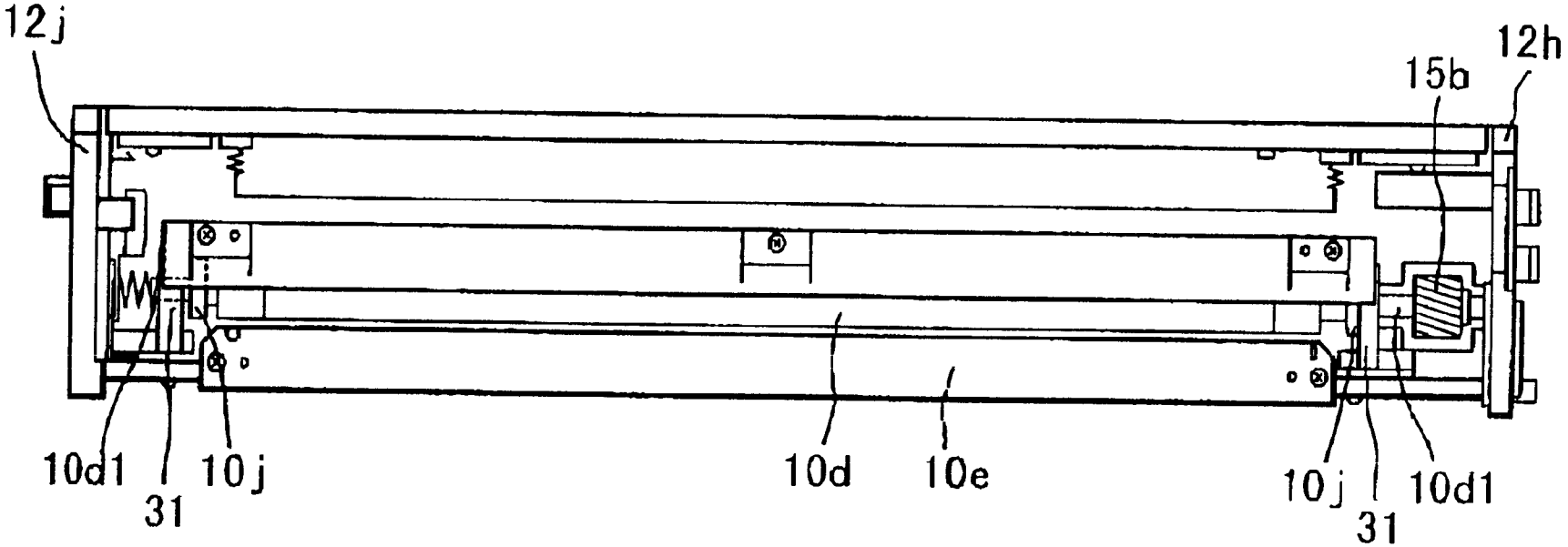
FIG. 17 is a side view of a developing unit.

As shown in FIG. 2, the developing sleeve 10*d* is mounted to the developing frame 12 for swinging motion about a sleeve pivoting center. As shown in FIG. 17, the spacer roller 10*j* having a radius which is larger by the development gap than the developing sleeve 10*d* is engaged with the journal portion 10*d*1 having a reduced diameter at each of the opposite ends of the developing sleeve 10*d*. Outside the spacer roller 10*j*, there is provided a swingable arm 31 engaged with a journal 10*d*1.

Figure 18:
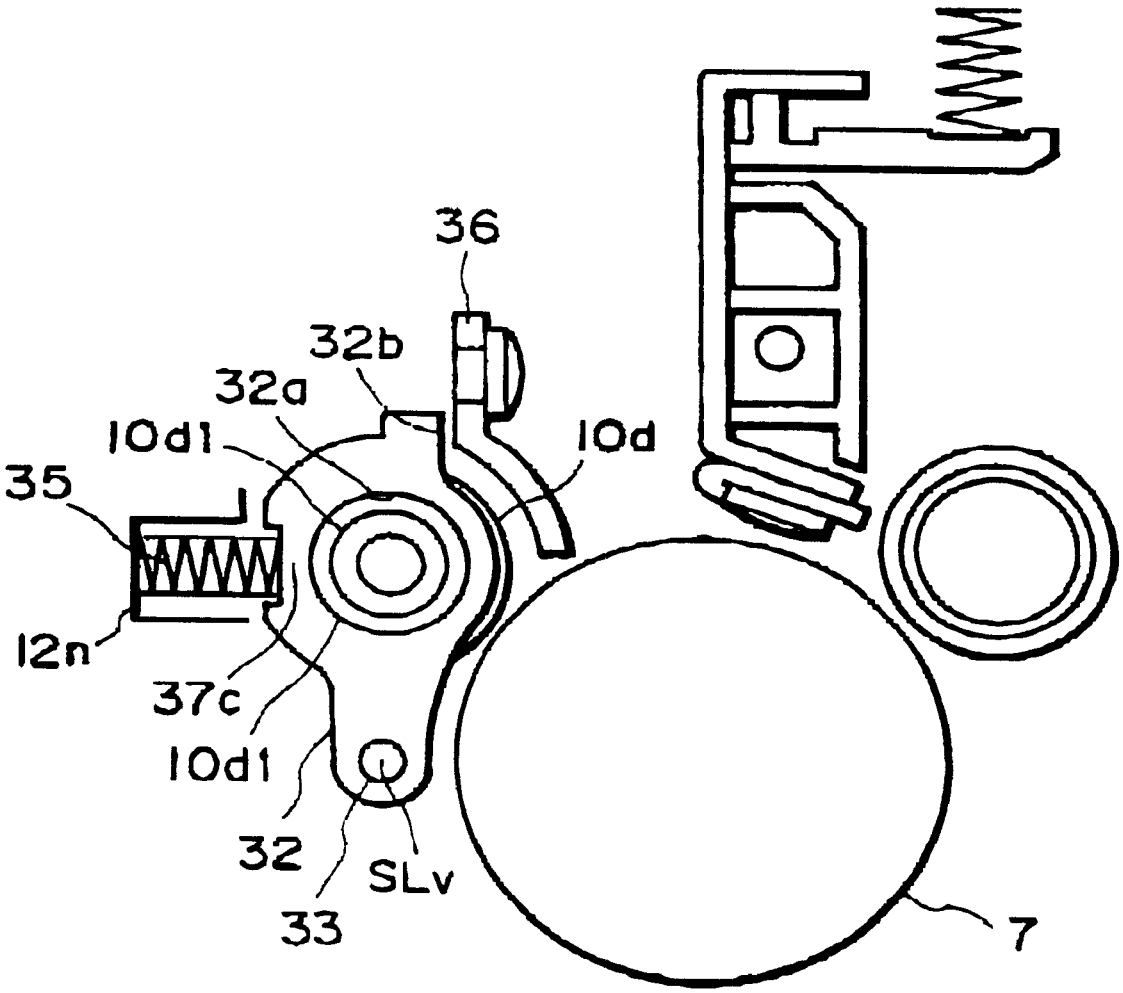
FIG. 18 is a front view showing a supporting portion of a developing sleeve.

FIG. 18 is a cross-sectional view of a developing sleeve 10*d* adjacent a lateral side of the swingable arm 32. A base portion of the swingable arm 32 is swingably supported on a supporting shaft press-fitted in the longitudinal direction relative to the opposite ends plate portions 12*h*, 12*i* of the developing frame 12. The swingable arm 32 is provided with a bearing hole 32*a* at a position substantially right above the supporting shaft 33, and a stopper portion 32*b* is provided thereabove. A spring seat 37*c* is provided on a line substantially perpendicular to the line connecting the center of the bearing hole 32*a* and the pressing center SLv which is a center of the supporting shaft 33.

The journal portion 10*d*1 at each of the opposite ends of the developing sleeve 10*d* is rotatably supported in the bearing hole 32*a* of the swingable arm 31. A compression coil spring 35 is compressed between the spring seat 37*c* and the spring seat 12*n* provided on the end plate portions 12*h*, 12*i* of the developing frame 12. By doing so, the developing sleeve 10*d* is rotated about the pressing center Slv toward the photosensitive drum 7 so that spacer rollers 10*j* are press contacted to the end portions of the photosensitive drum 7 at the positions outside the image region, by which the predetermined gap (0.2–1.0 mm) is maintained between the developing sleeve 10*d* and the photosensitive drum 7.

The stopper portion 32*b* is effective to prevent the swingable arm 31 from rotating outwardly in FIG. 18 by abutment to the developing sleeve cover 36 during assembling and disassembling operation. Therefore, in the process cartridge B which has been assembled, the stopper 31*b* is not contacted to the developing sleeve cover 36. The developing sleeve cover 36 is extended between the swingable arms 32 at the opposite longitudinal ends, and is screwed to the developing frame 12.

(Mounting-and-Demounting Structure of the Process Cartridge Relative to the Image Forming Apparatus)

At each of the left and the right portions of the upper portion of the process cartridge B as seen in the mounting-and-demounting direction, a guide portion 12*a*, 29*b* in the form of a flange as shown in FIGS. 3, 7 and so on, and the guide portions 12*a*, 29*b* are engaged with unshown guiding rails extended in the direction perpendicular to the sheet of the drawing when the process cartridge B is mounted to the main assembly 14 of the image forming apparatus.

The process cartridge B is provided with electric of contacts for electronic connection with contacts of the main assembly of the apparatus which are connected with an unshown high voltage source, when the process cartridge B is mounted to the main assembly 14 of the apparatus.

As shown in FIGS. 3, 8, a drum grounding contact 101 which is electrically connected with the photosensitive drum 7, is provided at a front side as seen in the mounting direction of the process cartridge B. As shown in FIGS. 7, 9, 10, an electroconductive brush contact 102 which is electrically connected to the electroconductive brush 11, a charging bias contact 103 which is electrically connected to the charging roller 8*a* and a developing bias contact 104 which is electrically connected to the developing sleeve 10*d*, are provided at the rear side with respect to the mounting direction of the process cartridge B.

Three driving force receiving portions constituting a shaft coupling rotatable about the axis on a rear, as seen in the mounting direction of the process cartridge B, are provided. When the process cartridge B is mounted to the main assembly of the apparatus, the three driving force receiving portions are coupled with a driver material of the main assembly 14 of the apparatus.

As shown in FIG. 7, the rear and surface of the process cartridge B is provided with the drum coupling 37*d*, the charge portion coupling 38 and the developing means coupling 39 which are retracted from the end surface and which are faced outwardly.

(Supporting and Driving Means for the Photosensitive Drum)

The drum coupling 37*d* is formed at an end of the drum flange 37 fixed to one end of the photosensitive drum 7.

Figure 19:
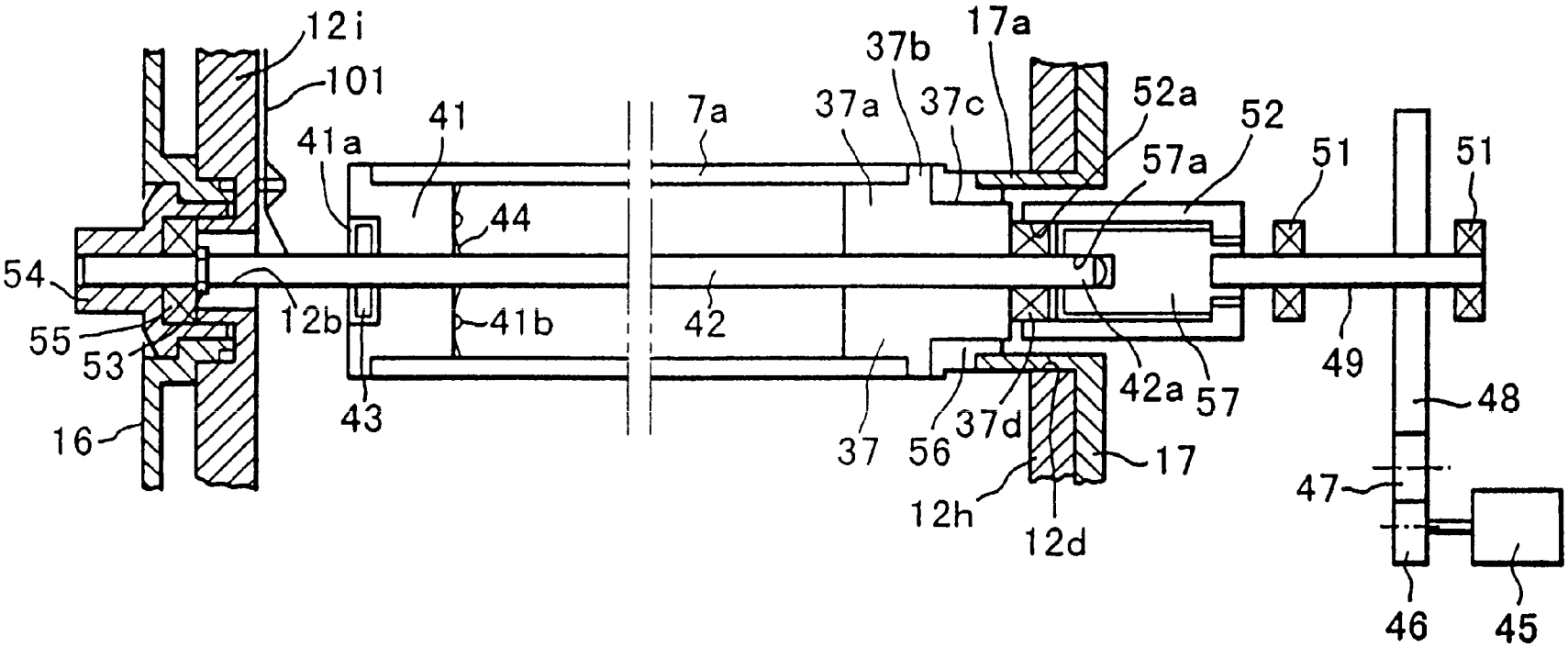
FIG. 19 is a longitudinal sectional view illustrating a supporting structure for an electrophotographic photosensitive drum and a driving device.

FIG. 19 illustrates a supporting method and a driving method for the photosensitive drum 7. The photosensitive drum 7 comprises a hollow aluminum cylinder, a photosensitive layer on the outer periphery thereof, a driving side drum flange 37 at one of the longitudinal ends and a nondriving side drum flange 41 at the other end. One end of the drum shaft 42 engaged with the drum flanges 37, 41 at the centers thereof penetrate the drum shaft supporting holes 12*b* formed in the end plate portions 12*i* of the developing frame 12. A pin 43 is penetrated through a hole of the drum shaft 42 and is snugly fitted in a groove 41*a* extended in the radial direction from the center hole of the drum flange 41. An electroconductive spring 44 is fixed to an inner end surface of the non driving side drum flange 41 to establish electrical connection between the drum shaft 42 and the drum cylinder 7*a*. More particularly, the electroconductive spring 44 is engaged into a dowel 41*b* of the drum flange 41, and the dowel 41*b* is melted and solidified. An end of the electroconductive spring 44 is press-contacted to the inner surface of the drum cylinder 7*a* by an elastic force, and the other end is press-contacted to the drum shaft 42.

One end of the drum grounding contact 101 amounted to the end plate portion 12*i* of the developing frame 12 is elastically contacted to the drum shaft 42. The drum grounding contact 101 is provided on the developing frame 12, and the other end is exposed to the outside of the process cartridge B to provide an outer contact.

The groove 12*c* is extended in the radial direction from the drum shaft supporting hole 12*b* provided at the end plate portion 12*i* and is penetrated by the pin 43 in the axial direction.

The driving side drum flange 37 is provided with a mounting portion 37*a* engageable with the drum cylinder 7*a,* a flange 37*b* contacted to the drum cylinder 7*a* end, a journal portion 37*c* having a diameter smaller than that of the flange 37*b,* and a male coupling projection 37*d* projected in the axial direction from the center portion of the end surface of the journal portion 37*c,* which are arranged in the order named in the axial direction. The driving side drum flange 37 having those portions is integrally molded from plastic resin material.

The journal portion 37*c* is rotatably engaged, through a collar 56, with a support portion 17*a* formed integrally on the rear part cover 17 engaged into the hole 12*d* of the end plate portion 12*h* of the developing frame 12.

Figure 20:
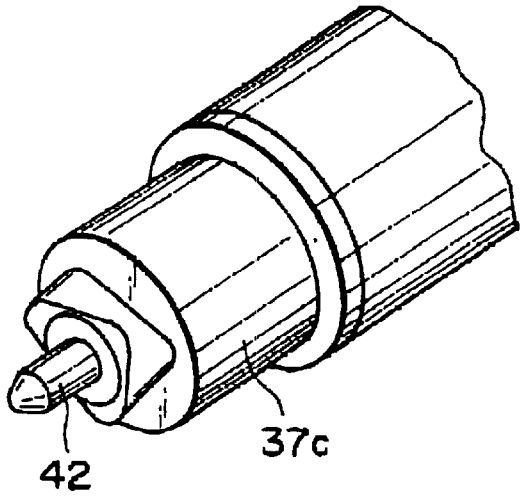
FIG. 20 is a perspective view of a driving side drum flange.

As shown in FIG. 20, the male coupling projection 37*d* is in the form of a twisted equilateral triangular prism having a common center with the drum shaft 42. The circumscribed circle diameter is smaller than the diameter of the journal portion 37*c*.

The driving device in the main assembly 14 of the apparatus comprises a motor 45 fixed to the main assembly, a pinion 46 fixed to the motor shaft of the motor 45, an intermediary gear 47, a large gear 48, a large gear shaft 49 which is fixed to the large gear 48 and which has a centering portion 57 rigidly coupled to an end thereof, a bearing 51 supporting the large gear shaft 49, and a female coupling shaft 52, The intermediary gear 47 may be a train of two-speed gear.

The bearing 51 supports the large gear shaft 49 such that the large gear shaft 49 is prevented from movement in the axial direction. The female coupling recess 52*a* has a hole complimentary with the twisted equilateral triangular prism, and is engaged with and disengaged from the male coupling projection 37*d* in the axial direction. When the male coupling projection 37*d* and the female coupling recess 52*a* are engaged with each other, the ridge lines of the twisted equilateral triangular prism of the male coupling projection 37*d* are contacted to the surfaces of the twisted triangular hole of the female coupling recess 52*a,* by which the male coupling projection 37d and the female coupling recess 52*a* are aligned with each other axially so that their centers of rotation are aligned with each other. Between the centering portion 57 and the female coupling recess 52, there is a small amount of play in the circumferential direction. In the foregoing, the female coupling shaft 52 takes a predetermined position when it moves most to toward the process cartridge B, and is engageable against the spring force.

The supporting portion of the drum shaft 42 at the nondriving side is structured such that drum shaft 42 is prevented from moving toward the nondriving portion side. As shown in Figure, a stopper ring 53 is provided on the drum shaft 42. The bearing 55 is accommodated in a bearing case 54 which is fixed to the end plate part cover 16 which in turn is fixed to the end plate portion 12*i* of the developing frame 12. Inner and outer end surfaces of the bearing 55 are abutted to the stopper ring 53 and the bearing case 54 so that motion of the drum shaft 42 toward the nondriving is stopped. In order to permit the photosensitive drum 7 to move in the axial direction with a limit, the facing distance between the support portion 17a and the bearing 55 is longer than the facing distance between the stopper ring 53 and the collar 56.

With this structure, when the process cartridge B is mounted to the main assembly 14 of the image forming apparatus, the position of the cartridge frame (developing frame 12, front part cover 16 and the rear part cover 17) in the longitudinal direction is determined relative to main assembly 14. In addition, the free end portion 42*a* of the drum shaft 42 is engaged into the center hole 57*a* of the centering portion 57, and the male coupling projection 37*d* is engaged with the female coupling recess 52*a*. When the motor 45 rotates, the pinion 46, the middle and the large gear 48 are rotated, and the female coupling shaft 52 is rotated by the large gear shaft 49 through the centering portion 57. By this rotation, the twisted male coupling projection 37*d* and the twisted female coupling recess 52*a* are attracted toward each other, so that drum flange 37 and the female coupling shaft 52 are attracted toward each other until the free end of the male coupling projection 37*d* is abutted to the bottom surface of the female coupling recess 52*a*. Thus, the axial position of the photosensitive drum 7 is determined to a predetermined position relative to the female coupling shaft 52.

When the male coupling projection 37*d* and the female coupling recess 52*a* are not engaged with each other upon the mounting of the process cartridge B to the apparatus, the end surface of the male coupling projection 37*d* presses against the edge of the opening of the female coupling shaft 52 by which the female coupling shaft 52 is retracted against the spring force toward the process cartridge B. Therefore, after the process cartridge B is mounted, the engagement instantaneously or case when the phases of the male coupling projection 37*d* and the recess 52*a* are aligned during a prerotating operation. It is an alternative that in place of abutment between the end surface of the male coupling projection 37*d* and the bottom of the female coupling recess 52*a,* the flange rear part cover 17 through the collar 56 by the attracting force produced by the coupling engagement.

In this embodiment, the process cartridge contains the developing means and the charging means capable of collecting the toner, and the photosensitive drum as a unit. However, the structure of the engagement and disengagement between the driving force receiving portion of the photosensitive drum and the driver material of the main assembly of the image forming apparatus, and the supporting structure for the photosensitive drum relative to the cartridge frame are applicable to other process cartridges, generally.

(Driving for the Developing Sleeve)

Figure 13:
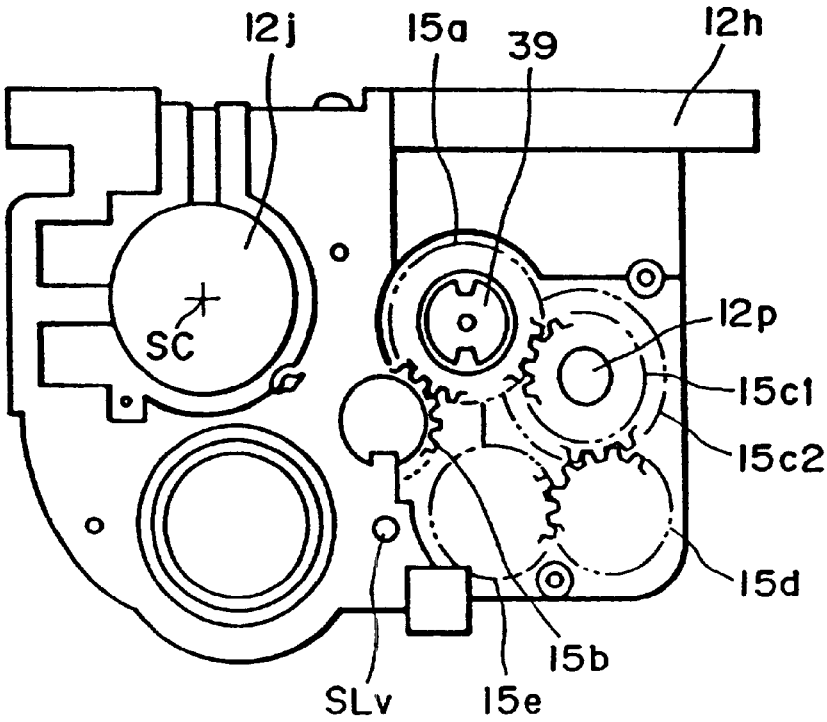
FIG. 13 is a rear view of a developing unit without a rear cover.
Figure 21:
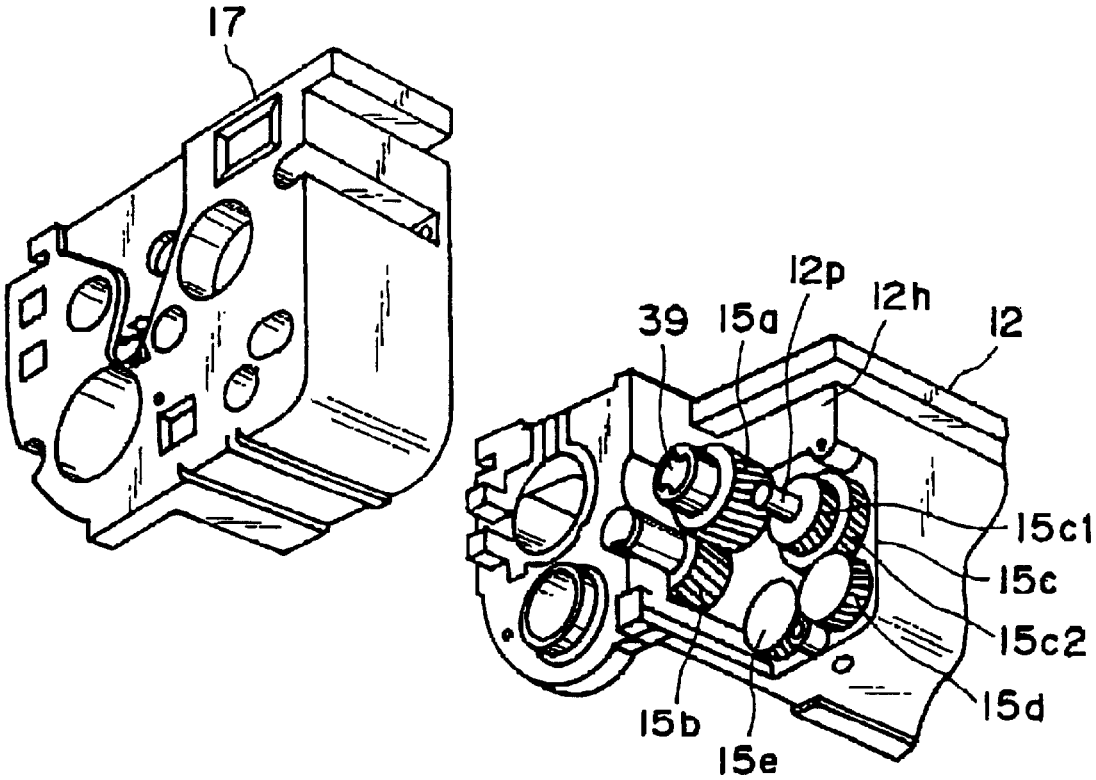
FIG. 21 is a perspective view of a process cartridge as seen from rear bottom side with the rear cover omitted.

As shown in FIG. 17, a developing sleeve gear 15*b* is fixed to the developing sleeve 10*d* at a petition longitudinally outside of the journal portion 10*d*1. As shown in FIGS. 7, 13, 21, the developing sleeve gear 15*b* is in mashing engagement with the developing zone driving gear 15*a*. The developing zone driving gear 15*a* is integrally molded with the developing means coupling 39 which functions as a rotational driving force receiving member for the developing means and is provided with a cylindrical hole at a rear side center of the developing means coupling 39. The cylindrical hole of the developing means coupling 39 with the developing zone driving gear 15*a* is rotatably engaged with an unshown shaft portion provided on an end plate portion 12*h* of the developing frame 12 and extended in the longitudinal direction.

The developing zone driving gear 15*a* is engaged with a small gear 15*c*1 of the two-speed gear 15*c*.

The two-speed gear 15*c* is rotatably engaged with a shaft portion 12*p* integrally extended from the end plate portion 12*h* in the longitudinal direction. The large gear 15*c*2 of the two-speed gear 15*c* is engaged with a stirring gear 15*d* connected with the rear shaft end of the stirring screw shown in FIG. 2. The stirring gear 15*d* is in meshing engagement with the stirring gear 15*e* connected to the rear shaft end of the stirring screw 10*h*. The stirring gears 15*d*, 15*e* are provided with unshown journal portions at the axially middle position, and are also provided at the free ends with unshown connecting portions for collection with the stirring screw s, respectively. The said journal portions are engaged in unshown bearing bores formed in the end plate portion 12*h* of the developing frame 12 to be supported thereby. The said connecting portions are engaged with the front ends of the stirring screws 10*h*, 10*g* so that stirring screws 10*g*, 10*h*, 10*h* are driven.

Figure 14:
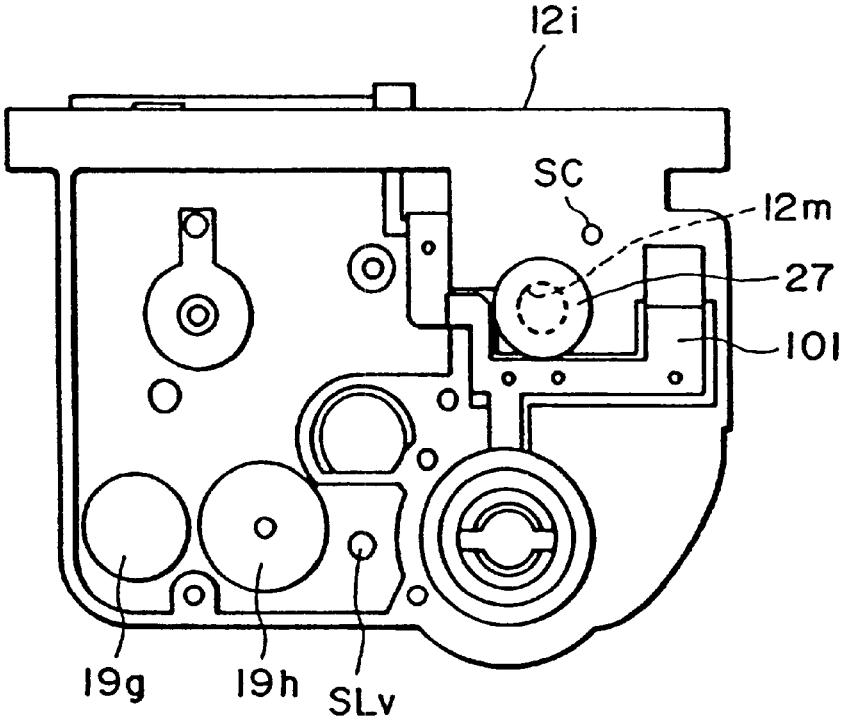
FIG. 14 is a front view of a developing unit without a front cover.
Figure 15:
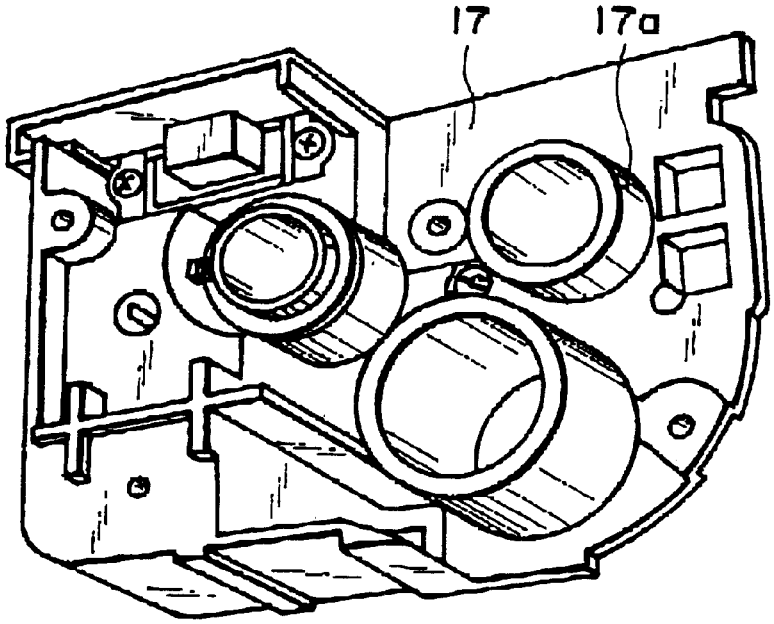
FIG. 15 is a perspective view of an inside of a rear cover.
Figure 16:
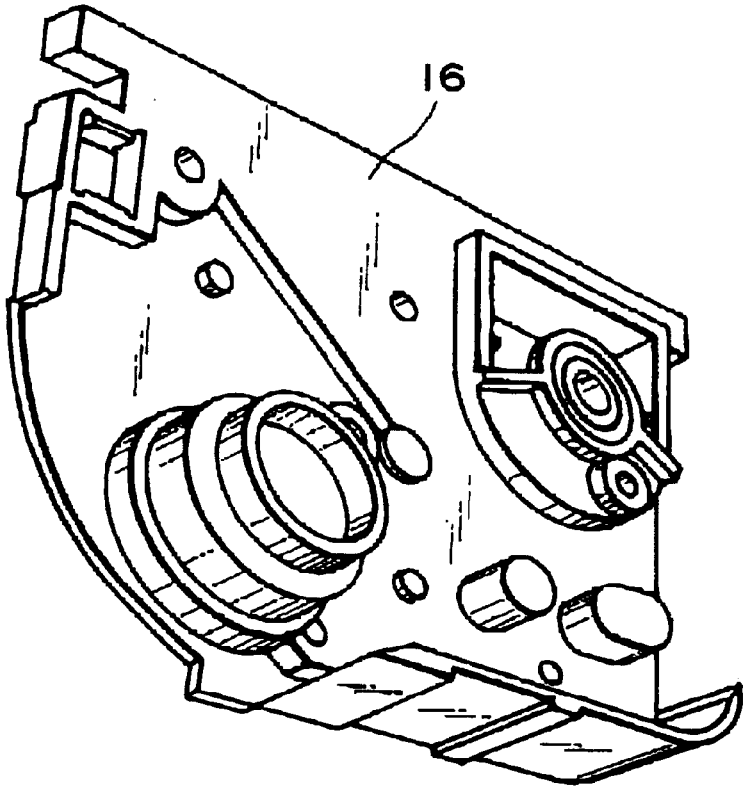
FIG. 16 is a perspective view of an inside of a front cover.

The front side shaft ends of the stirring screw 10*g* and 10*h* has a center hole, and as shown in FIG. 14, and the center hole is rotatably engaged with the supporting shaft 19*g* and, 19*h* extended into the developing frame 12 and press-fitted into the longitudinal hole of the end plate portion 12*i* which is disposed at longitudinal opposite end of the end plate portion 12*h* of the developing frame 12.

When the process cartridge B is mounted to the main assembly 14 of the apparatus, and the driving force is transmitted from the main assembly 14, the developing means coupling 39 rotates. The developing zone driving gear 15*a* integral with the developing means coupling 39 rotates the developing sleeve gear 15*b* so as to rotate the developing sleeve 10*d*. The developing zone driving gear 15*a* drivers the stirring gear 15*d* through the two-spead gear 15*c*, and the stirring gear 15*d* transmits the rotation to the stirring gear 15*e*. By this, the stirring screws 10*g*, 10*h* are rotated to stir the toner while circulating it.

The developing sleeve 10*d* rotates in the same rotational direction as the photosensitive drum 7. Therefore, at the position where the peripheral surface of the developing sleeve 10*d* and the peripheral surface of the photosensitive drum 7 are opposed to each other (developing zone), the peripheral surfaces are moved in the opposite directions from each other. The spacer rollers 10*j* (FIG. 17) are rotatably supported at the end portions roller on the photosensitive drum 7, and are moved in the opposite direction relative to the developing sleeve 10*d*.

The gears 15*a*, 15*b*, 15*c*, 15*d*, 15*e* are covered by the rear part cover 17 fixed in contact with the end plate portion 12*h* of the developing frame 12 as shown in FIG. 21.

(Driving for the Charging Roller)

Figure 23:
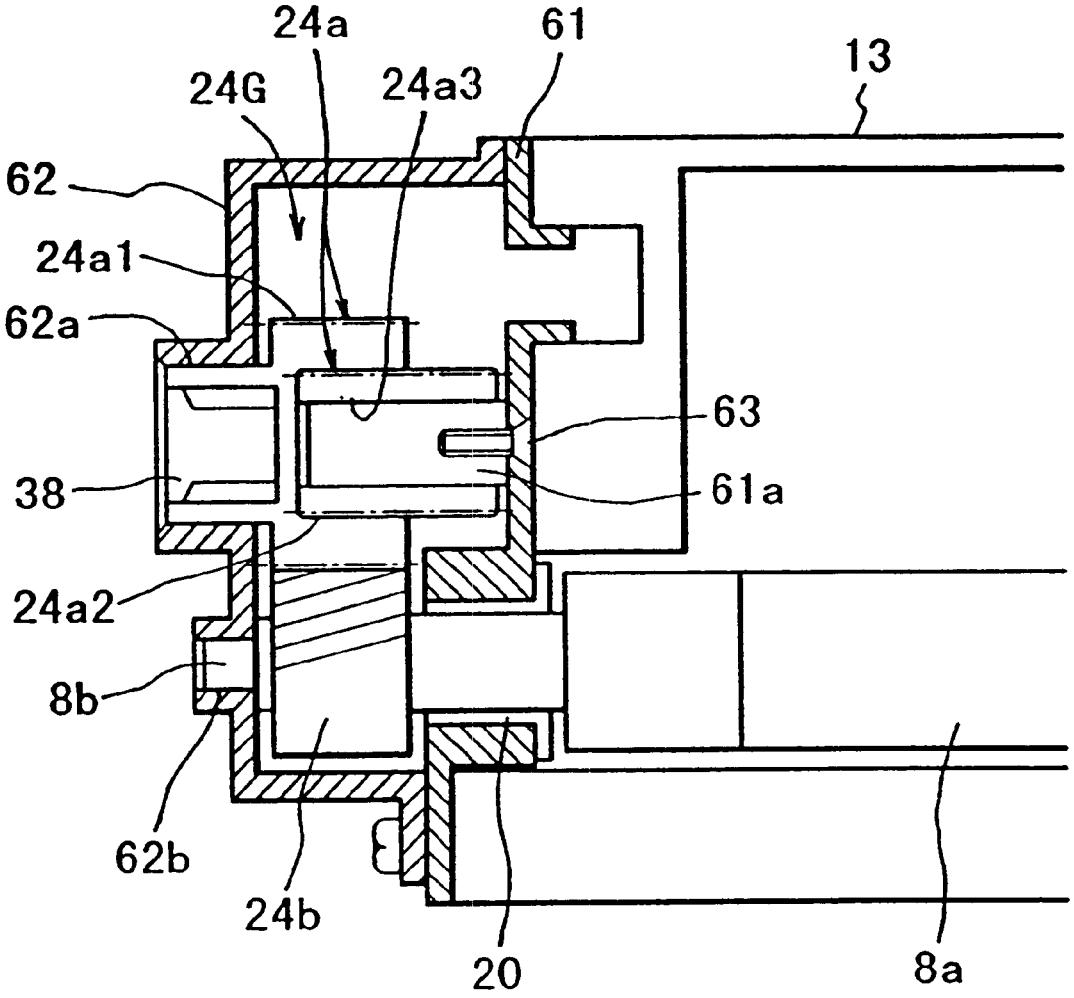
FIG. 23 is an A–B–C–D–E sectional view of the device shown in FIG. 2.
Figure 24:
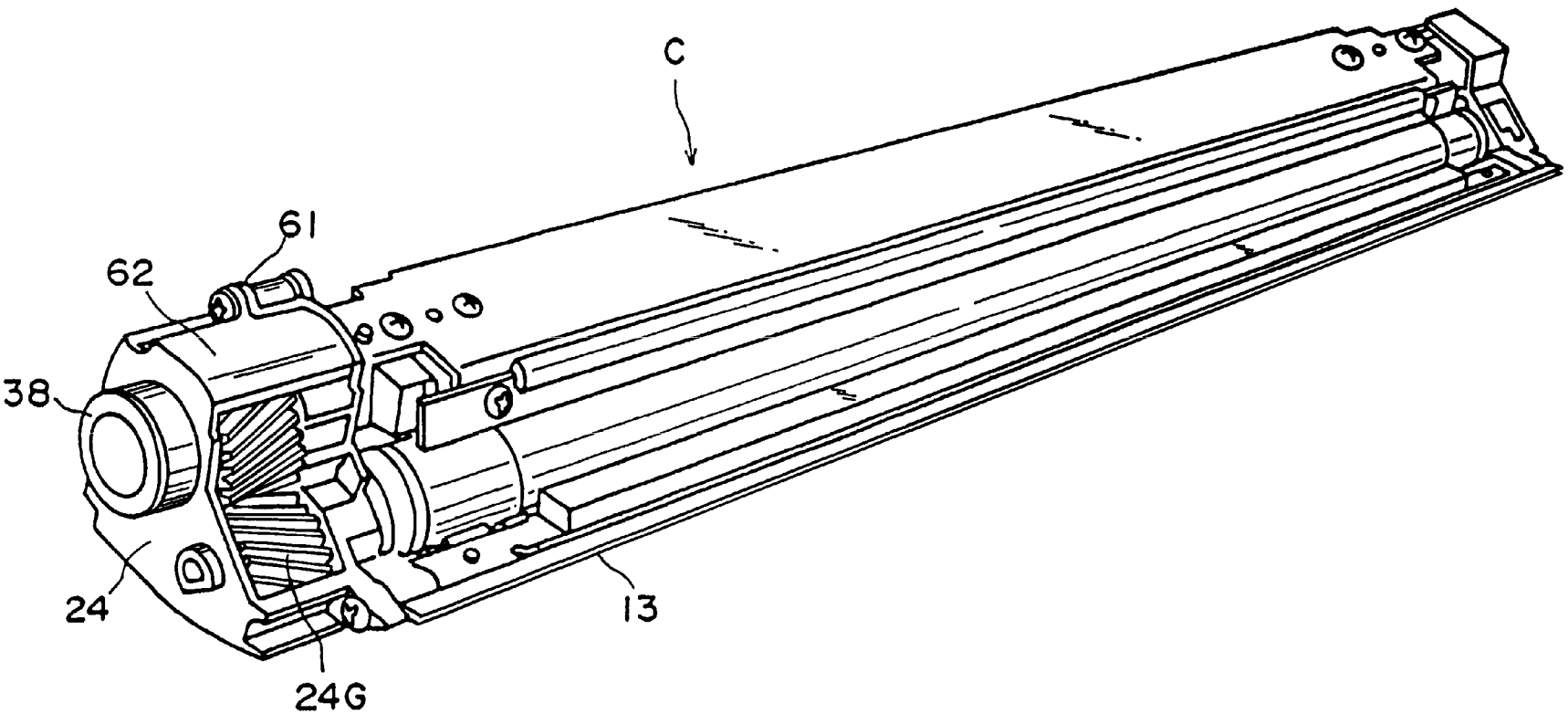
FIG. 24 is a perspective view of a charging unit.

As shown in FIGS. 11, 23, 24, the gear unit 24 fixed to the longitudinally rear end of the charging unit C includes a gear array 24G which is accommodated in gear cases 61, 62 of two-piece type.

The gear cases 61, 62 are split from each other in the longitudinal direction, and the gear case 61 is contacted to a rear end side (longitudinal direction) of the charging frame 13, and the gear case 61, 62 are fastened together to the charging frame 13.

Figure 22:
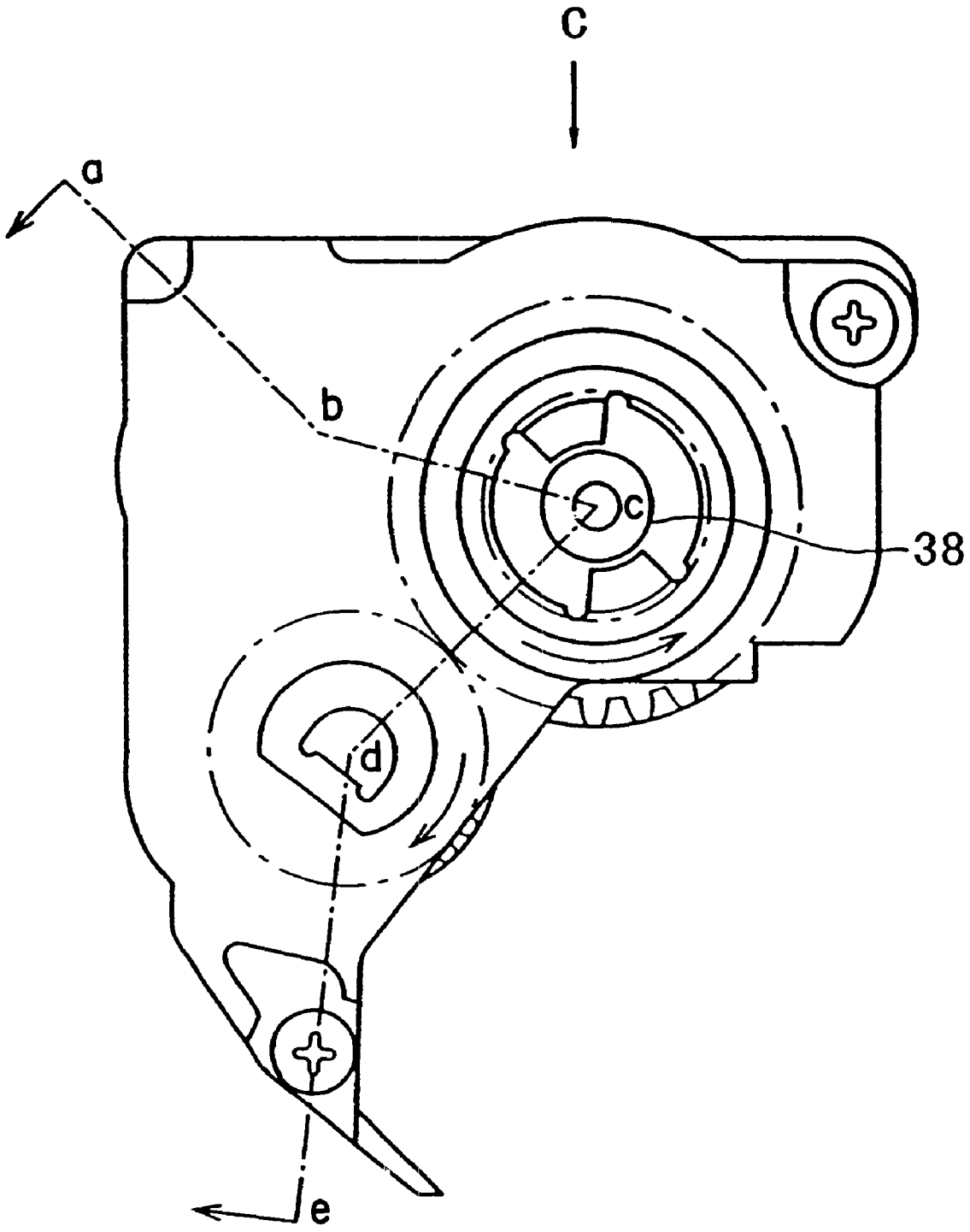
FIG. 22 is a front view of a charging unit.

FIG. 22 is a front view of a rear end of the charging unit C as seen in the longitudinal direction.

FIG. 23 is a sectional view taken along a line a–b–c–d–e in FIG. 22. A charge portion coupling 38 is provided with an integral two-speed gear 24*a*. The two-speed gear 24*a* has a center hole 24*a*3 which is rotatably engaged with a supporting shaft 61*a* fastened on the gear case 61 by small screws 63 and projected in the longitudinal direction. The supporting shaft 61*a* may be integrally formed with the gear case 61. Charging roller 8*a* is rotatably supported in a charging roller bearing 20 which is provided at a rear side and which is engaged to the charging frame 13 mounting portion.

A large gear 24*a*1 of the two-speed gear 24*a* is in meshing engagement with a charging roller gear 24*b* fixed to one end of the charging roller 8*a*. The hole 62*b* of the gear case 62 supports a one and of the magnet 8*b*. The large gear 24*a*1 of the two-speed gear 24*a* and the small gear 24*a*2 are securedly fixed. They may be integrally molded.

(Driving Device for the Process Cartridge)

The main assembly 14 of the apparatus is provided with a driving device for the process cartridge B. The driving device is in the form of a driving unit having three coupling for engagement with the male coupling projection 37*d*, the charge portion coupling 38 and the developing means coupling 39 of the process cartridge B, respectively. A driving device for driving the photosensitive drum 7 as shown in FIG. 19 is different from this embodiment, and therefore, the description of this embodiment does not apply to the reference numerals in FIG. 19.

The three couplings are driven from three driving sources which are independent from each other. Therefore, the photosensitive drum 7, the charging roller 8*a* and the developing sleeve 10*d* are free of influence from any of the other driving systems, so that smoothness and quick start of the rotation of the photosensitive drum 7 are particularly accomplished.

There is provided respective driving units at the rear sides of the cartridge mounting portions of the main assembly 14 for the process cartridges B cartridge mounting portion as shown in FIG. 1

Figure 25:
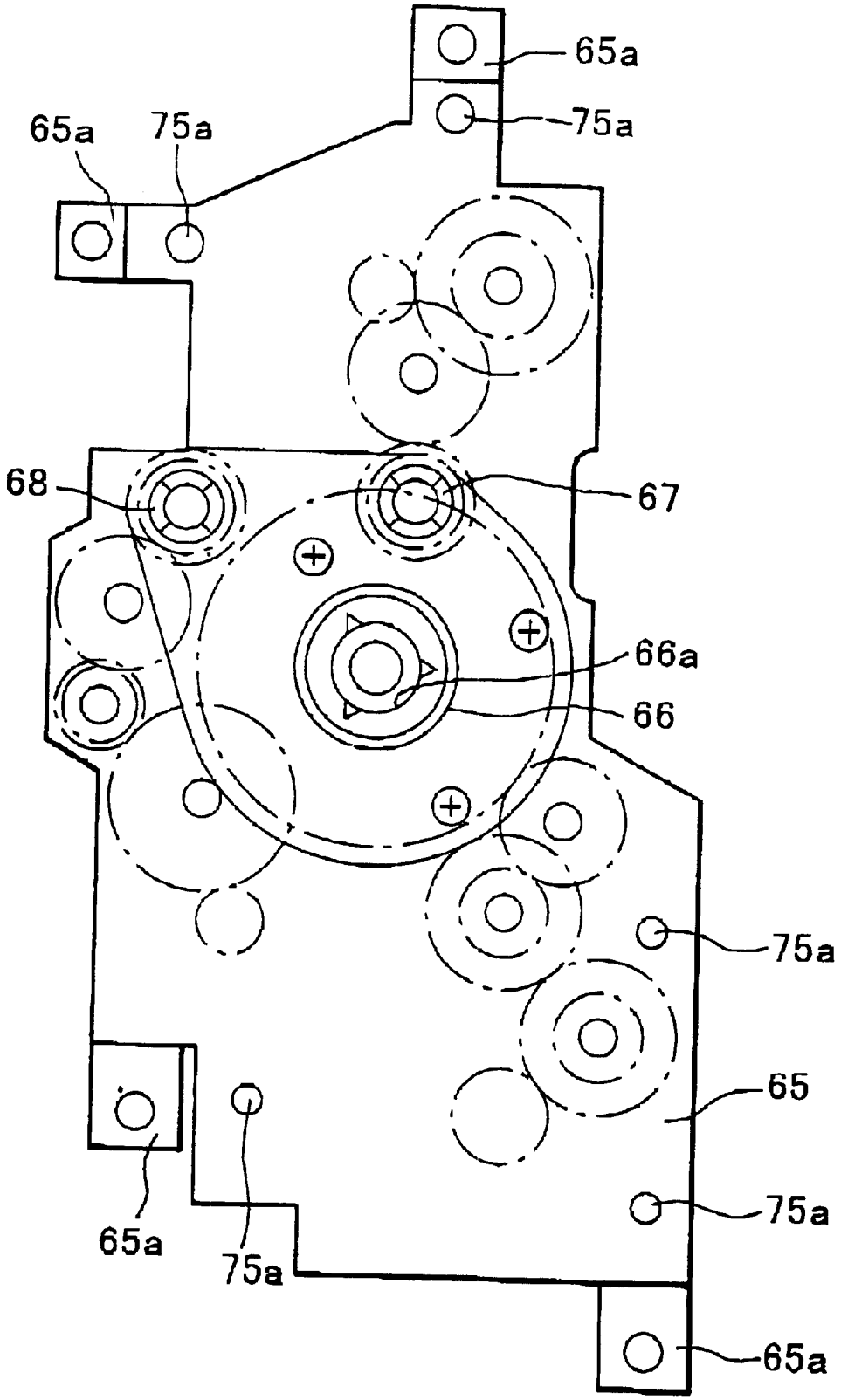
FIG. 25 is a front view of a driving unit provided in the main assembly.
Figure 26:
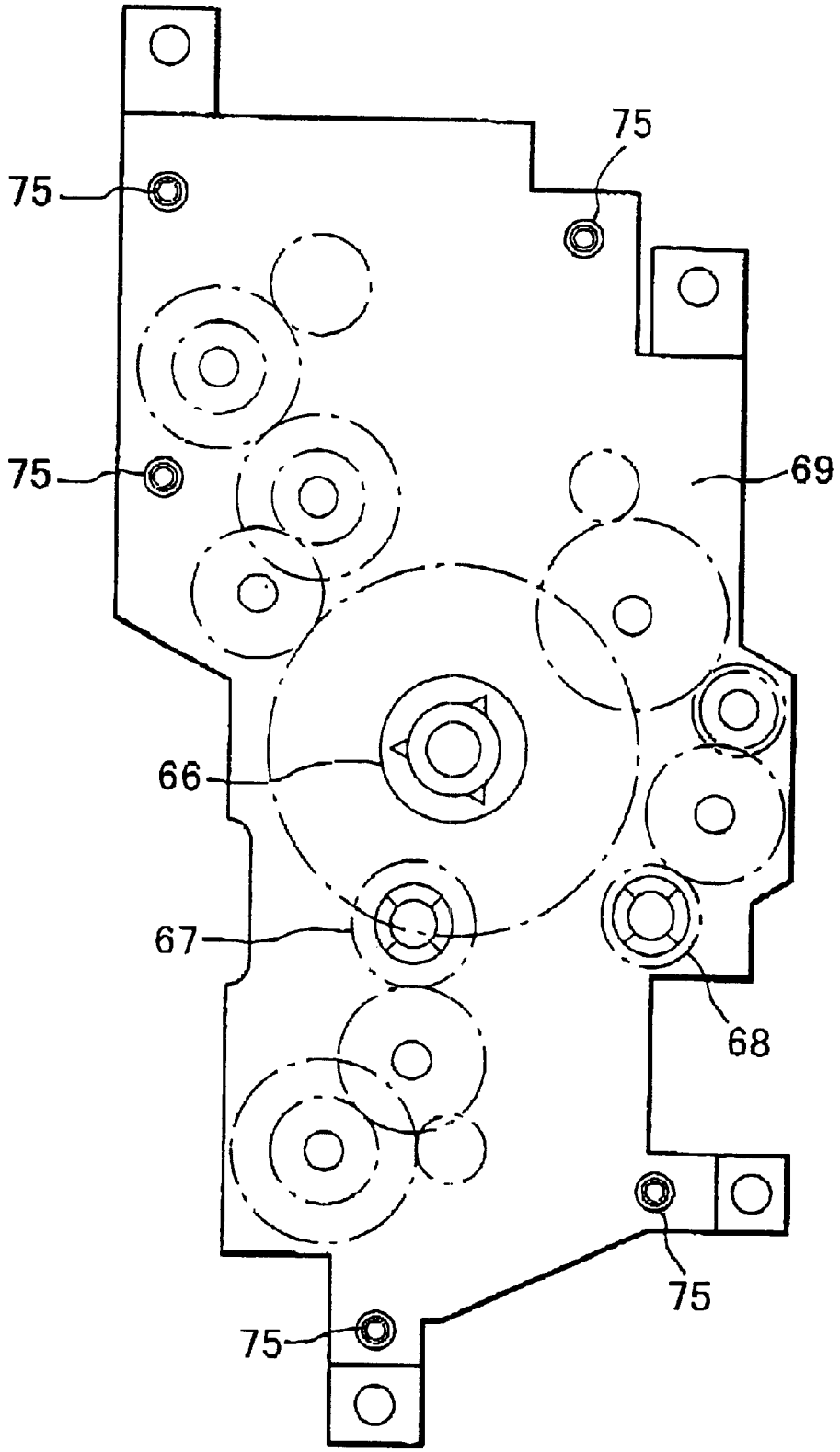
FIG. 26 is a front view of the device shown in FIG. 25 with the front plate removed.
Figure 27:
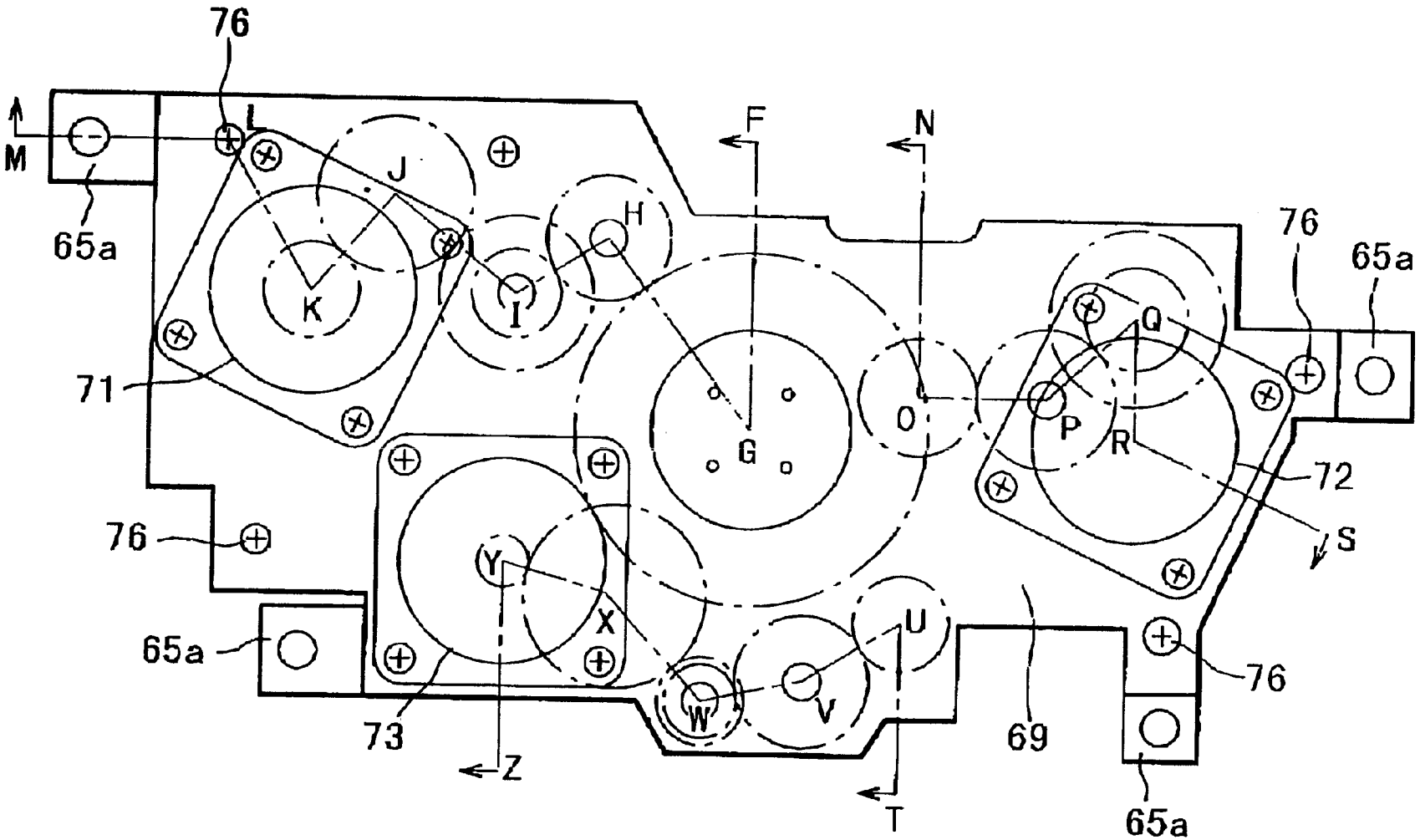
FIG. 27 is a rear view of a driving unit provided in the main assembly.
Figure 28:
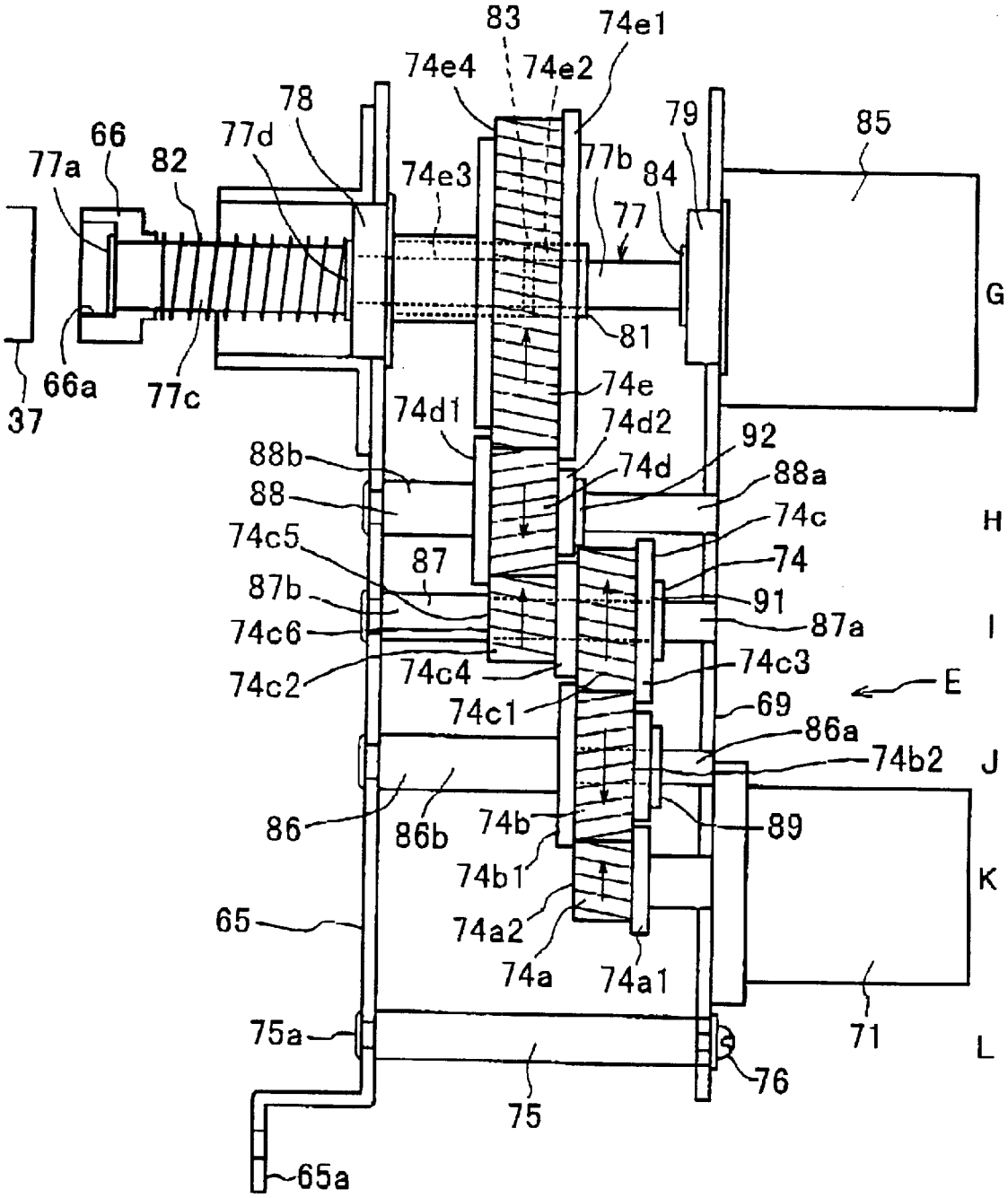
FIG. 28 is a F–G–H–I–J–K–L–M sectional view of the device shown in FIG. 27.
Figure 29:
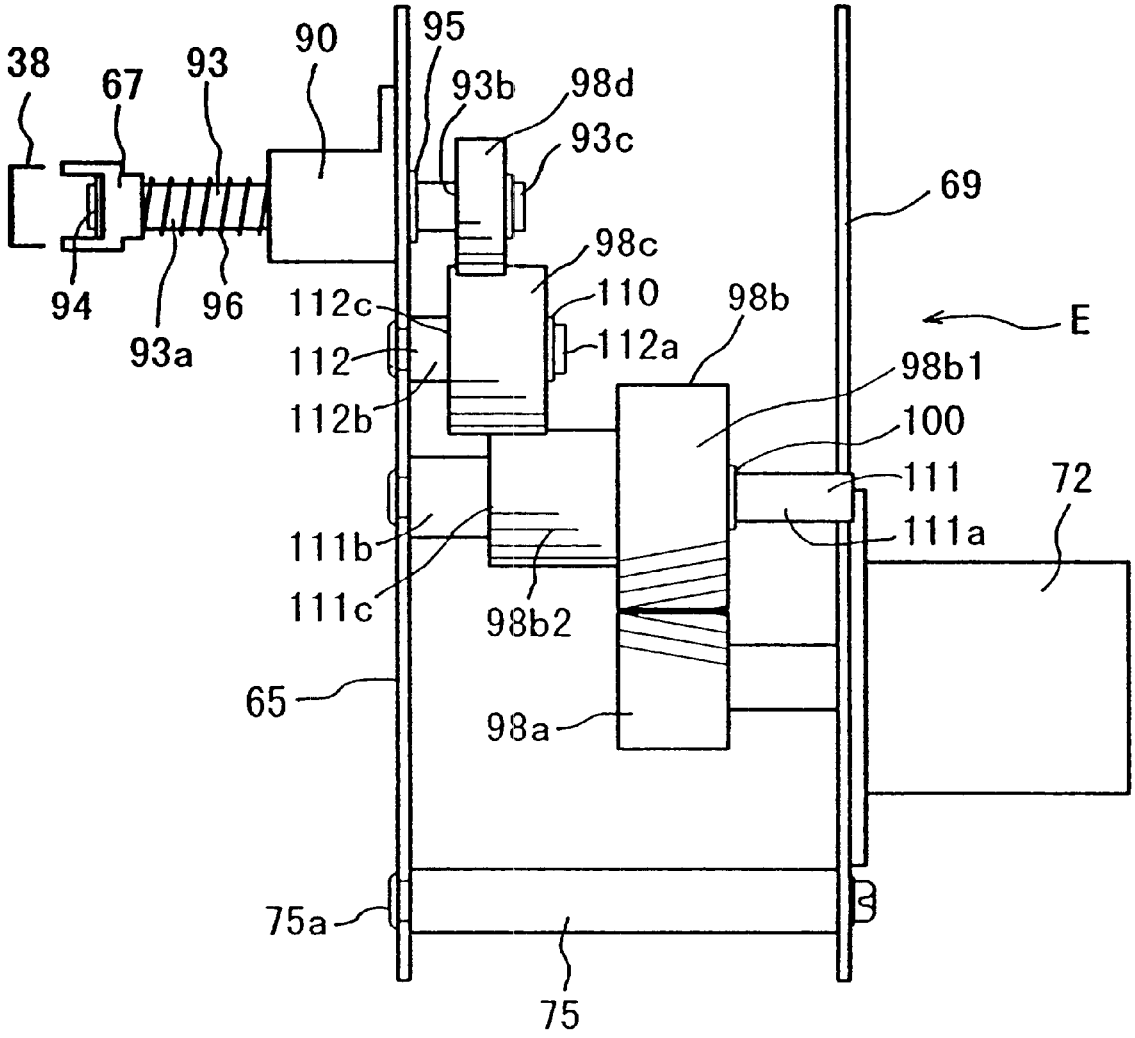
FIG. 29 is a N–O–P–Q–R–S section of the device shown in FIG. 27.
Figure 30:
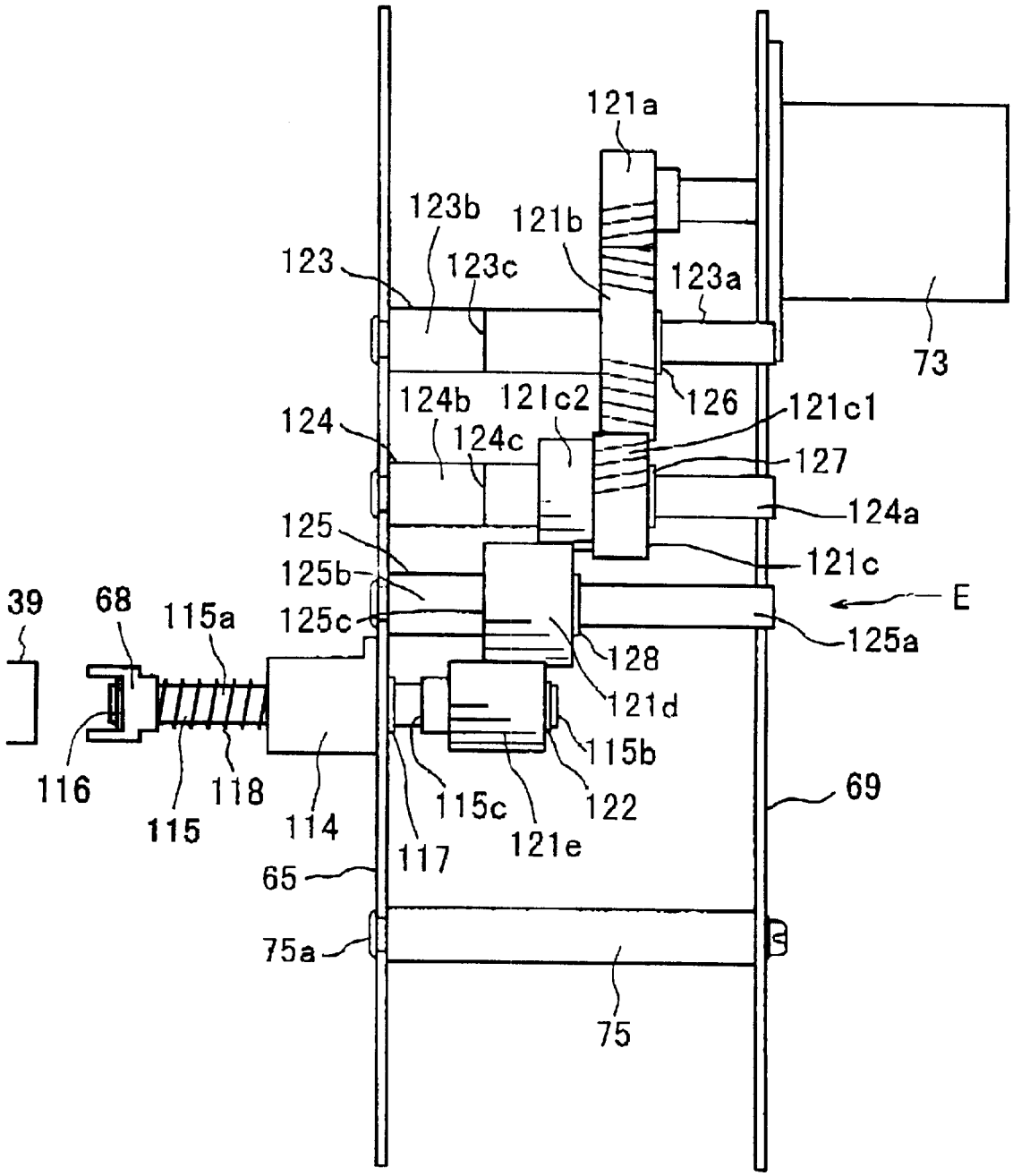
FIG. 30 is a T–U–V–W–X–Y–Z sectional view of the device shown in FIG. 27.

FIG. 25 is a front view of the driving unit, FIG. 26 is a front view thereof with a front plate omitted, and FIG. 27 is a rear view of a driving unit. In FIG. 25 to FIG. 27, gears are simply indicated by pitch circles. FIG. 28 is a sectional view taken along a line F–G–H–I–J–K–L–M in FIG. 27. FIG. 29 is a sectional view taken along a line N–O–P–Q–R–S in FIG. 27. FIG. 30 is a sectional view taken along a line T–U–V–W–X–Y–Z in FIG. 27.

As shown in FIG. 25, the front side of the driving unit is provided with a driving side coupling 66 having a female coupling recess 66a engageable with the male coupling projection 37*d* of the process cartridge B, a charge portion driving coupling 67 engageable with the charge portion coupling 38 of the process cartridge B, and a developing zone driving coupling 68 engageable with the developing means coupling 39 of the process cartridge B, which are projected from a front plate 65 toward an inserting direction of the process cartridge B (the longitudinal direction, perpendicular to the sheet of the drawing of FIG. 25).

As shown in FIG. 27, a motor 71 which is a driving source for the photosensitive drum 7, a motor 72 which is a driving source for the charging roller 8*a* and a motor 73 which is a driving source for the developing sleeve 10*d* are fixed to the outside of the rear plate 69. Motor shafts of the motors 71, 72, 73 are projected between the front plate 65 and the rear plate 69. The motor 71 for driving the photosensitive drum 7 is a servomotor, and the motor shaft is extended out rearwardly, too.

The front plate 65 and the rear plate 69 which are flat plates, are connected by a plurality of stays 75 to make the front plate 65 and the rear plate 69 parallel with each other. As shown in FIG. 28 to FIG. 30, each of the stays 75 is fixed to the front plate 65 by crimping 75*a* at one end, and the other end is contacted to the inside of the rear plate 69 and is fixed to the rear plate 69 by a small screw 76 threaded and then through the stay 75 from the opposite side of the rear plate 69. The driving unit E is mounted to the main assembly 14 of the apparatus at a plurality of mounting portions 65*a* (four, in this embodiment) by small screws apparatus, the mounting portion 65*a* being offset from the front plate 65.

As shown in FIG. 28, a gear train 74 is disposed between the photosensitive drum driving coupling 66 and the motor 71.

(Driving Device for Photosensitive Drum)

As shown in FIG. 28, the coupling shaft 77 is supported by a bearing 78 fixed to the front plate 65 and a bearing 79 fixed to the rear plate 69, and the photosensitive drum driving coupling 66 is engaged for axial movement with the D-cut shaft portion 77*c* having a diameter smaller than the diameter of the flange 77*a* at the front end. Between the bearing 78 having a flange and the D-cut shaft portion 77*c*, a compression coil spring 82 is compressed, and the coupling 66 is urged to the front flange 77*a* of the D-cut shaft portion 77*c*. The shaft portion 77*b* supported by the bearing 78 has the same diameter toward the rear side, and the diameter thereof is smaller than the diameter of the D-cut shaft portion 77*a*. A stepped portion 77*d* provided by the diameter reduction is abutted by an inner ring of the bearing 78, and a boss 74*e*3 of the large gear 74*e* is abutted to the bearing 78. The large gear 74*e* is prevented from axial movement by a retaining ring 81 which is contacted to the side opposite from the side abutted to the bearing 78. The stopper ring 81 is engaged in the groove extending in the circumferential direction of the shaft portion 77*b*. A pin 83 penetrated throughout the diameter of the shaft portion 74*e*1 is engaged in the keyway 74*e*2 of the large gear 74*e*. The bearing 79 having the flange is engaged in the rear plate 69 and is prevented from axial movement by a stopper ring 84 engaged in a groove extending in a circumferential direction of the shaft portion 77*b*.

The coupling shaft 77 is extended rearwardly from the rear plate 69 and is provided with detecting means for detecting a rotational angle of the coupling shaft 77, in the form of an encoder 85 or the like.

A pinion gear 74*a* is fixed to the output shaft portion of the motor 71 and is engaged with a gear 74*b*, which is engaged with the large gear 74*c*1 of the two-speed gear 74*c* integral therewith. A gear 74*d* is engaged with the small gear 74*c*2 of the two-speed gear 74*c* and is engaged with the large gear 74*e*. The intermediary gears 74*b*, 74*c*, 74*d* are rotatably fitted around the reduced diameter portions 86*a*, 87*a*, 88*a* of the fixed shafts 86, 87, 88, respectively, and the axial movement thereof is permitted through a short distance and is limited by the stepped portions provided by the large diameter shaft portions 86*b*, 87*b*, 88*b* of the fixed shafts 86, 87, 88 and the small diameter portions 86*a*, 87*a*, 88*a* and the stopper rings 89, 91, 92 engaged in the circumferential grooves of the small diameter portions 86*a*, 87*a*, 88*a*. The one side ends of the fixed shafts 86, 87, 88 are crimped into a hole of the front plate 65, and the other ends is engaged into a hole of the rear plate 69.

Each of the gears 74*a*–74*e* are helical gears, and the pinion gear 74*a* is twisted clockwisely, and the large gear 74*e* is twisted clockwisely.

As shown in FIG. 28, each of the gears 74*a*–74*e* is provided with flanges 74*a*1, 74*b*1, 74*c*3, 74*c*4, 74*d*1, 74*e*1. The side surfaces of these flanges are abutted to the side surfaces of the gears with which the gears having the flanges, respectively. Noting the gears which are engaged with each other, the flanges are disposed at the opposite sides with the teeth portions are therebetween in the axial direction.

The gears are rotated in such directions that peripheral surfaces are moved in the directions indicated by an arrow in FIG. 28. More particularly, they are rotated in the direction of rotating the photosensitive drum 7 in the couter-clockwise direction.

When the motor 71 rotates, the gear 74*b* which is in meshing engagement with the gear 74*a* of the motor shaft receives a righward thrust in FIG. 28. The thrust is received by the side surface 74*b*2 of the gear 74*b* sliding and rotating relative to the flange 74*a*1 which is integral with the pinion gear 74*a* of the motor shaft and/or the flange 74*c*3 of the large gear 74*c*1 of the two-speed gear 74*c*. Or, the thrust is received by the flange 74*b*1 of the gear 74*b* and the side surface 74*a*2 of the pinion gear 74*a* of the motor shaft. Further, it is received by abutment of the flange 74*b*1 to the side surface 74*c*6 of the large gear 74*c*1 of the two-speead gear 74*c*. The thrust may be received by one or more of the above-described portions, but from the standpoint of manufacturing error, it may be received by only one of them.

The twisting directions of the large gear 74*c*1 and the small gear 74*c*2 are the same, and due to the twisting direction, the thrust is leftward in FIG. 28. The thrust is received by at least one of the abutment between the flange 74*c*3 of the large gear 74*c*1 of the two-speed gear 74*c* and the side surface 74*b*2 of the gear 74*b*, the contact between the flange 74*c*4 of the small gear 74*c*2 and the side surface 74*d*2 of the gear 74*d*, the abutment between the side surface 74*c*5 of the small gear 74*c*2 and the flange 74*d*1 of the gear 74*d*, and the abutment between the side surface 74*c*7 of the large gear 74*c*1 and the flange 74*b*1 of the gear 74*b*.

The thrust of the gear 74*d* is imparted in the righthand direction in FIG. 28 and is received by at least one of the abutment between the flange 74*d*1 and the side surface 74*c*5 of the small gear 74*c*2 of the two-speed gear 74*c*, the abutment between the side surface 74*d*2 of the gear 74*d* and the flange 74*c*4 of the small gear 74*c*2 of the two-speed gear 74*c*, the abutment between the side surface 74*d*2 of the gear 74*d* and the flange 74*e*1 of the large gear 74*e*, and the flange 74*d*1 and the side surface 74*e*4 of the large gear 74*e*. As described hereinbefore, the large gear 74*e* is mounted to the coupling shaft 77 and is prevented from axial movement.

The axial positions of the gears 74*b,* 74*c,* 74*d* are limited between the stepped portions which are formed between the large diameter shaft portions 86*b,* 87*b,* 88*b* of the fixed shafts 86, 87, 88 and the diameter-reduced shaft portions 86*a,* 87*a,* 88*a* and the stopper rings 89, 91, 92, and therefore, thrust forces of the intermediary gears 74*b,* 74*d* are received by the stopper rings 89, 92, and the thrust force of the intermediary gear 74*c* is received by the stepped portion of the fixed shaft 87.

In this manner, the axial positions of the pinion gear 74*a* of the motor shaft and he large gear 74*e* of the coupling shaft 77 are determined by the supporting shaft. The axial positions of the pinion gear 74*a* of the motor shaft, the large gear 74*e* and the intermediary gears 74*b,* 74*c,* 74*d* are determined by the abutment between the flange and the side surfaces of the gears, and therefore, the axial (with respect to the fixed shafts 86, 87, 88) movement of each of the gears 74*b,* 74*c,* 74*d* are permitted through a small distance.

(Driving Device for Charging Roller)

FIG. 29 shows a charge portion driving device portion provided with a coupling which is engageable with and disengageable from the charge portion coupling 38. As shown in FIG. 29, a charge portion driving coupling 67 is provided coaxially with the charge portion coupling 38 for engagement with the charge portion coupling 38. The coupling pair constitutes a jaw clutch, and peaks and valleys are interraced to transmit the rotating force. The charge portion driving side coupling 67 is engaged for axial movement with the coupling shaft 93 which is supported for rotation and axial movement by an unshown bearing fitted in the bracket 90 fixed to the front plate 65. The shaft portion 93*a* of the coupling shaft 93 engaged in the coupling 67 so that coupling 67 and the coupling shaft 93 are integrally rotated. Stopper rings 94, 95 are fitted in the circumferential grooves at the front end of the coupling shaft 93 and the back side of the front plate 65. Between the coupling 67 and the bracket 90, a compression coil spring 96 is compressed around the coupling shaft 93.

The large gear 98*b*1 of the two-speed gear 98*b* is in meshing engagement with the pinion gear 98*a* fixed to the pinion gear 98*a* of which in turn fixed to the rear plate 69, and the gear 98*c* which is in meshing engagement with the small gear 98*b*2 of the two-speed gear 98*b* is in meshing engagement with the gear 98*d* fixed to the rear end of the coupling shaft 93. The rear end of the coupling shaft 93 has a reduced diameter portion with a strapped portion 93*b,* and the diameter-reduced shaft portion 93*c* has D-cut cross-section, and the gear 98*d* is prevented from axial movement by the stepped portion 93*b* and the stopper ring 99 engaged in the circumferential groove of the D-cut shaft portion 93*c*. The face width of the gear 98*c* is larger than the facewidth of the gear 98*d* such that gears 98*c,* 98*d* are always in meshing engagement with each other, within the range of axial mobility of the gear 98*d* with the coupling gear 98.

One end of the two-speed gear 98*b* is fixed by crimping into the front plate 65, and the other end thereof is rotatably supported by the diameter-reduced portion 111*a* of the fixed shaft 111 fitted in the rear plate 69. The axial movement of the two-speed gear 98*b* is limited between the stepped portion 111*c* between the large diameter shaft portion 111*b* of the fixed shaft 111 and the diameter reduced portion 111*a* thereof and the stopper ring 100 engaged in circumferential groove of the diameter-reduced portion 111*a*. The pinion gear 98*a* and the large gear 98*b*1 of the two-speed gear 98*b* are helical gears.

The gear 98*c* is rotatably fitted around the diameter-reduced portion 112*a* of the fixed shaft 112 which is crimped into the front plate 65 at its one end, and the axial movement thereof is limited by the stepped portion 112*c* formed between the large diameter shaft portion 112*b* of the fixed shaft 112 and the diameter-reduced portion 112*a* and the stopper ring 110 engaged in the circumferential groove of the diameter-reduced portion 112*a*.

(Driving Device for Developing Sleeve)

FIG. 30 shows a driving device portion in the main assembly of the apparatus for driving the developing sleeve 10*d*.

A developing means driving side coupling 68 is disposed coaxially with the developing means coupling 39 shown in FIG. 25 and is engageable with the developing means coupling 39. The coupling pair constitutes a jaw clutch, which the peaks and valleys are interraced to transmit the rotational force.

The developing means driving side coupling 68 is engaged for axial movement with the coupling shaft 115 which is supported for rotation and for axial movement by an unshown bearing fitted in the bracket 114 fixed to the front plate 65. The shaft portion of the coupling shaft 115 fitted in the developing means driving side coupling 68 has a D-cut cross-section. The D-shaped hole of the coupling 68 is engaged with the shaft portion 115*a* having the D-cut cross-section so that coupling 68 and the coupling shaft 115 are rotated integrally. Stopper rings 116, 117 are engaged in circumferential grooves at the prior end of the coupling shaft 115 and the back side of the front plate 65. Between the developing means driving side coupling 68 and the bracket 114, a compression coil spring 118 are fitted around the coupling shaft 115 and is compressed.

A pinion gear 121*a* fixed to the motor shaft of the motor 73 fixed to the rear plate 69 is in meshing engagement with a large gear 121*c*1 of a two-speed gear 121*c* through a gear 121*b,* and a gear 121*d* which is in meshing engagement with a small gear 121*c*2 of the two-speed gear 121*c*1 is engaged with a gear 121*e* fixed to the rear end of the coupling shaft 115. A diameter of a rear end of the coupling shaft 115 is reduced by a stepped portion 115*c,* and the diameter-reduced portion 115*b* has a D-cut cross-section. The axial movement of the gear 121*e* is limited by the stepped portion 115*c* and a ring 122 engaged in the circumferential groove of the diameter-reduced portion 115*b*.

The two-speed gear 121*c,* the two-speed gear 121*c* and the gear 121*d* are crimped and fixed to the front plate 65 at their one side ends, and the other ends thereof are rotatably supported on diameter-reduced portions 123*a,* 124*a,* 125*a* of the fixed shaft 123, 124, 125 engaged into the rear plate 69. The axial movement of the gears 121*b,* 121*c,* 121*d* are prevented by the stepped portions 123*c,* 124*c,* 125*c* formed between the large diameter shaft portions 123*b,* 124*b,* 125*b* of the fixed shafts 123. 124, 125 and the diameter-reduced portions 123*a,* 124*a,* 125*b* and retainer rings 126, 127, 128 which are engaged in circumferential grooves of the diameter-reduced portions 123*a,* 124*a,* 125*a*. The pinion gear 121*a,* the gear 121*b* and the large gear 121*c*1 of the two-speed gear 121*c* are helical gears.

As described in the foregoing, the coupling 66 for driving the photosensitive drum 7, the charge portion driving side coupling 67, the developing means driving side coupling 68 of the driving device E provided in the main assembly 14 of the apparatus, are driven by the photosensitive drum driving motor 71, the charging roller driving motor 72, the developing sleeve driving motor 73, respectively, which are independent from each other, through respective gear trains. In this manner, the photosensitive drum 7 is not interrelated with the charging roller 8*a,* the developing sleeve 10*d,* the

10*g,* 10*h* or the like, and therefore, the rotation of the photosensitive drum 7 is not influenced by variation of load such as stirring screws 10*g,* 10*h* or the like. At the time of start of rotation of the photosensitive drum 7, the photosensitive drum 7 is free of the stirring resistance load and is free of the inertia loads of the charging roller 8*a* and the developing sleeve 10*d* and of the inertia load of the gear trains operably connecting the developing sleeve 10*d,* the stirring screw 10*g* and, 10*h.* Therefore, the rotational speed of the photosensitive drum 7 is uniform, and the time required for starting up the photosensitive drum 7 is short.

When the process cartridge B is inserted into the main assembly 14 of the apparatus in the longitudinal direction, the male coupling projection 37*d* of the coupling 37 integral with the photosensitive drum 7 is brought into engagement with the female coupling recess 66*a* of the driving unit E in the main assembly 14 of the apparatus. When the engagement does not occur, the photosensitive drum driving coupling 66 is moved back (rightward) against the spring force of the compression coil spring 82 in the axial direction on the coupling shaft 77 in FIG. 28. So, the end surfaces of the couplings 37, 66 are abutted to each other. When the motor 71 starts to rotate, when the phases of the male coupling projection 37*d* and the female coupling recess 66*a* are matched with each other, the coupling 66 slides on the coupling shaft 77 by the spring force of the compression coil spring 82 by which the male coupling projection 37*d* and the female coupling recess 66*a* are brought into engagement with each other. At this time, the driving side coupling 66 is abutted to the flange 77*a* provided at the end of the coupling shaft 77 so that position thereof is determined in the axial direction. The male coupling projection 37*d* and the female coupling recess 66*a* are in the form of twisted equilateral triangular prism and twisted hole complimentary with the equilateral triangular prism, which are loosely fitted with each other so that edge lines of the equilateral triangular prism of the male coupling projection 37*d* are contacted to the surfaces of the twisted hole of the female coupling recess 66*a,* by which attraction force is produced toward each other, and in addition, an aligning function is accomplished the so that axis of the photosensitive drum 7 and the axis of the coupling shaft 77 are aligned with each other. By the attraction between the male coupling projection 37*d* and the female coupling recess 66*a,* the end of the male coupling projection 37*d* is abutted to the flanged (flange 77*a*) end of the coupling shaft 77. The axial position of the coupling shaft 77 is determined relative to the driving unit E fixed to the main assembly 14 of the apparatus, and therefore, by the document between the male coupling projection 37*d* and the coupling shaft 77, the axial position of the photosensitive drum 7 is determined relative to the main assembly 14 of the apparatus.

By the attraction between the male coupling projection 37*d* and the female coupling recess 66*a,* the coupling shaft 77 is pulled leftwardly in FIG. 28, but the boss 74*e*3 of the large gear 74*e* is abutted to the bearing 78 (having the flange) correctly positioned relative to the front plate 65, and the stopper ring 81 is abutted to the large gear 74*e.*

When the process cartridge B is mounted to the main assembly 14 of the apparatus, the charge portion driving side coupling 67 is engaged with the male coupling projection 37*d* and the female coupling recess 66*a,* and the developing means driving side coupling 68 is engaged with the developing means coupling 39. At this time, if the peaks and valleys of the couplings 38, 67 or the 39, 68 are aligned to each other, they are immediately engaged. When the peaks and peaks are abutted to each other, the charge portion coupling 38, the developing means coupling 39 make the charge portion driving side coupling 67 and the developing means driving side coupling 68 against the coil springs 96, 118 on the coupling shaft 93, 115 backwardly. The charging roller driving motor 72 a drives the developing sleeve driving motor 73, and therefore, the charge portion driving side coupling 67 and the developing means driving side coupling 98 are rotated. The couplings 67, 68 are slid forwardly on the shaft portions 98*a,* 115*a* by the spring force of the compression coil springs 96, 118 when the phases of the charge portion coupling 38 and the [t] developing means coupling 39 are matched with each other, by which the coupling 38, 67 and the coupling 39, 68 are engaged with each other, respectively.

When the photosensitive drum driving motor 71 is rotated, the rotation force is transmitted from the pinion gear 74*a,* the gear 74*b,* two speed gear 74*c,* the gear 74*d,* the large gear 74*e* and the coupling shaft 77, so as to rotate the coupling 66 having the female recess 66*a,* and therefore, the photosensitive drum 7 is rotated by the rotation force transmitted from the female coupling recess 66*a* to the male coupling projection 37*d.*

The relative position in the axial direction of the middle gear for photosensitive drum 7 driving of the driving unit E, is determined by the side surfaces of the gears and the flanges. As described in the foregoing, the axial movement of the pinion 74*a* and the large gear 74*e* is prevented. In FIG. 28, the gears 74*b,* 74*d* receive thrust in the rightward direction, and the two-speed gear 74*c* receives thrust in the leftward direction, but the thrust is received by the side surface of the gear and the flange, so that axial position of the gears 74*b,* 74*c,* 74*d* are determined by the gears 74*b,* 74*c,* 74*d,* among them, and are determined relative to the pinion gear 74*a* and the large gear 74*e.* At this time, the flanges and the side surfaces of the gears are abutted to each other at a plurality of positions, and therefore, when one of the flanges and the side surface of the associated one of the gears, they are not abutted at the other position. The gears 74*b,* 74*c,* 74*d* are loosely limited by the stepped portions formed between the large diameter shaft portions 86*b,* 87*b,* 88*b* of the fixed shaft 86, 87, 88 and the diameter-reduced portions 86*a,* 87*a,* 88*a* and the stopper rings 89, 91, 92, so that axial positions thereof are not definitely defined.

(Gap Maintenance Between the Developing Sleeve and the Photosensitive Drum and Driving Gear for Developing Sleeve)

Figure 31:
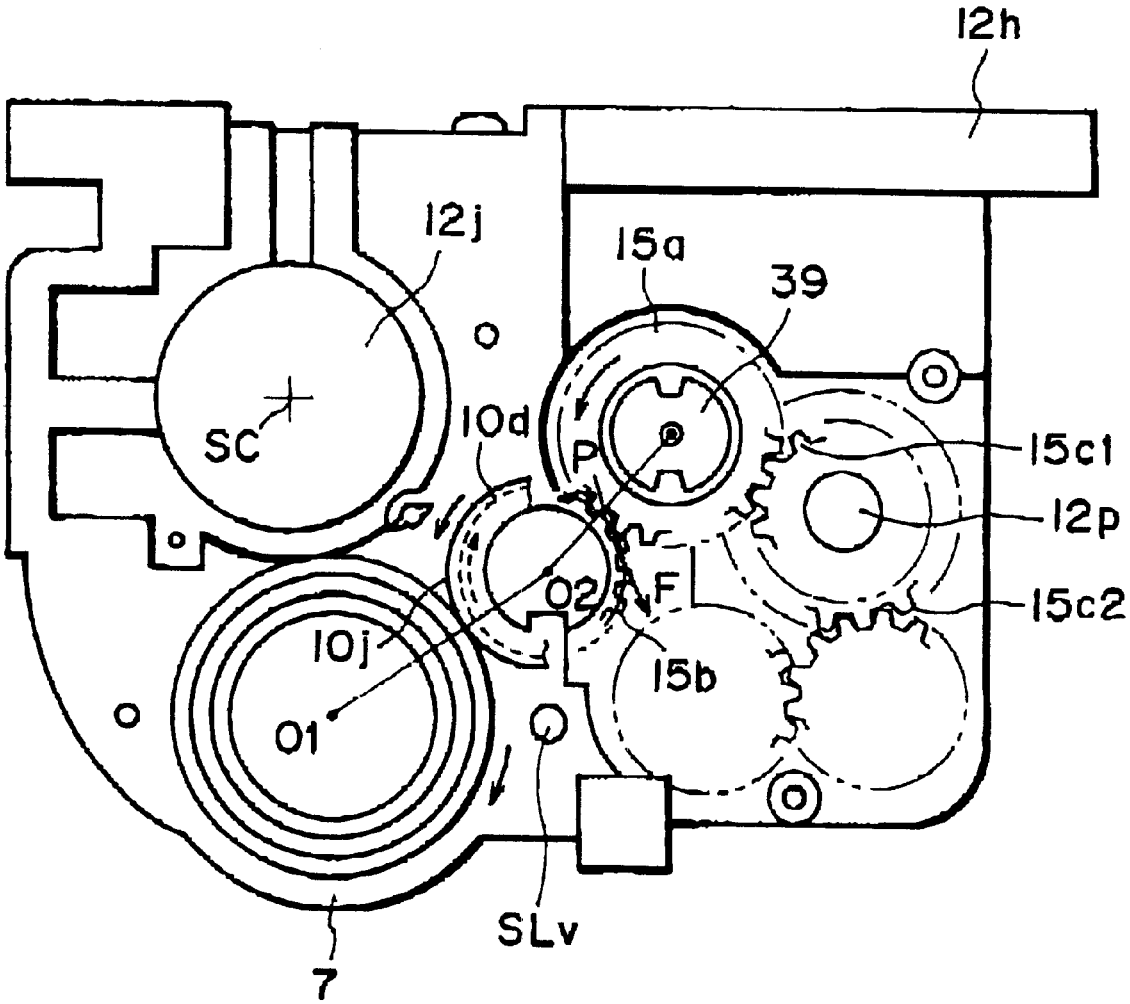
FIG. 31 is a rear view illustrating a load relationship of the driving device of the developing sleeve.

FIG. 31 shows a load relation when the rotating force is transmitted from the developing means coupling to the developing sleeve.

There is provided a gap between the photosensitive drum 7 and the developing sleeve 10*d* by a spacer roller 10*j* having a radius which is larger than the developing sleeve 10*d* by the development gap (the gap between the photosensitive drum 7 and the developing sleeve 10*d* in the developing zone), the spacer roller 10*j* being contacted to the outer periphery of the photosensitive drum 7.

As described in the foregoing, the photosensitive drum 7 and the developing sleeve 10*d* are rotated in the same rotational directions, and therefore, the peripheral surfaces of the photosensitive drum 7 and the developing sleeve 10*d* are moved in the opposite directions in the developing zone and at the longitudinal end portions. A journal portion 10*d*1 is provided at the of the end of portions of the developing sleeve 10*d,* and a spacer roller 10*j* is rotatably supported coaxially with the journal portion 10*d*1 adjacent longitudinally inside of the journal portion 10*d*1. As described in conjunction with FIG. 18, the journal portion 10*d*1 is rotatably engaged in the bearing hole 32*a* of the swingable arm 32 which is swingable about the pivot center SLv.

The swingable arm 32 is urged by the compression coil spring 35 to press contact the spacer roller 10*j* to the photosensitive drum 7 in the area outside the developing zone with respect to the longitudinal direction. Therefore, when the photosensitive drum 7 and then developing sleeve 10*d* are rotated, the spacer roller 10*j* rolls on the photosensitive drum 7 in the direction opposite from the developing sleeve 10*d*.

As shown in FIG. 31, when the developing means coupling 39 receives the rotating force from the coupling 68 of the driving unit provided in the main assembly 14 of the apparatus, the developing means coupling 39 and the driving gear 15*a* are rotated counterclockwisely, and the rotation is transmitted from the driving gear 15*a* to the developing sleeve gear 15*b*, so that developing sleeve 10*d* is rotated clockwisely.

In this embodiment, all the gears have involute tooth profiles. Therefore, the line of action of the tooth load F is inclined relative to the tangent line of the pitch circles of the gears 15*a*, 15*b* passing through the pitch point P by a pressure angle.

By parallel arrangement in which a line of action F of the tooth load and a line connecting a bearing hole 32*a* of the swingable arm 32 which is a sleeve supporting member and the center SLv of swinging action form an angle within a range of ±30°, so that influence of the tooth load to the press-contact force between the spacer roller 10*j* and the photosensitive drum 7 can be reduced. Therefore, the pressure required by the compression coil spring 35 can be reduced. By doing so, the deformation of the spacer roller 10*j* due to creep which may be caused by small press-contact force relative to the photosensitive drum 7 when the process cartridge B is not yet used, can be prevented.

(Pressure Between the Charging Roller and the Photosensitive Drum)

Figure 32:
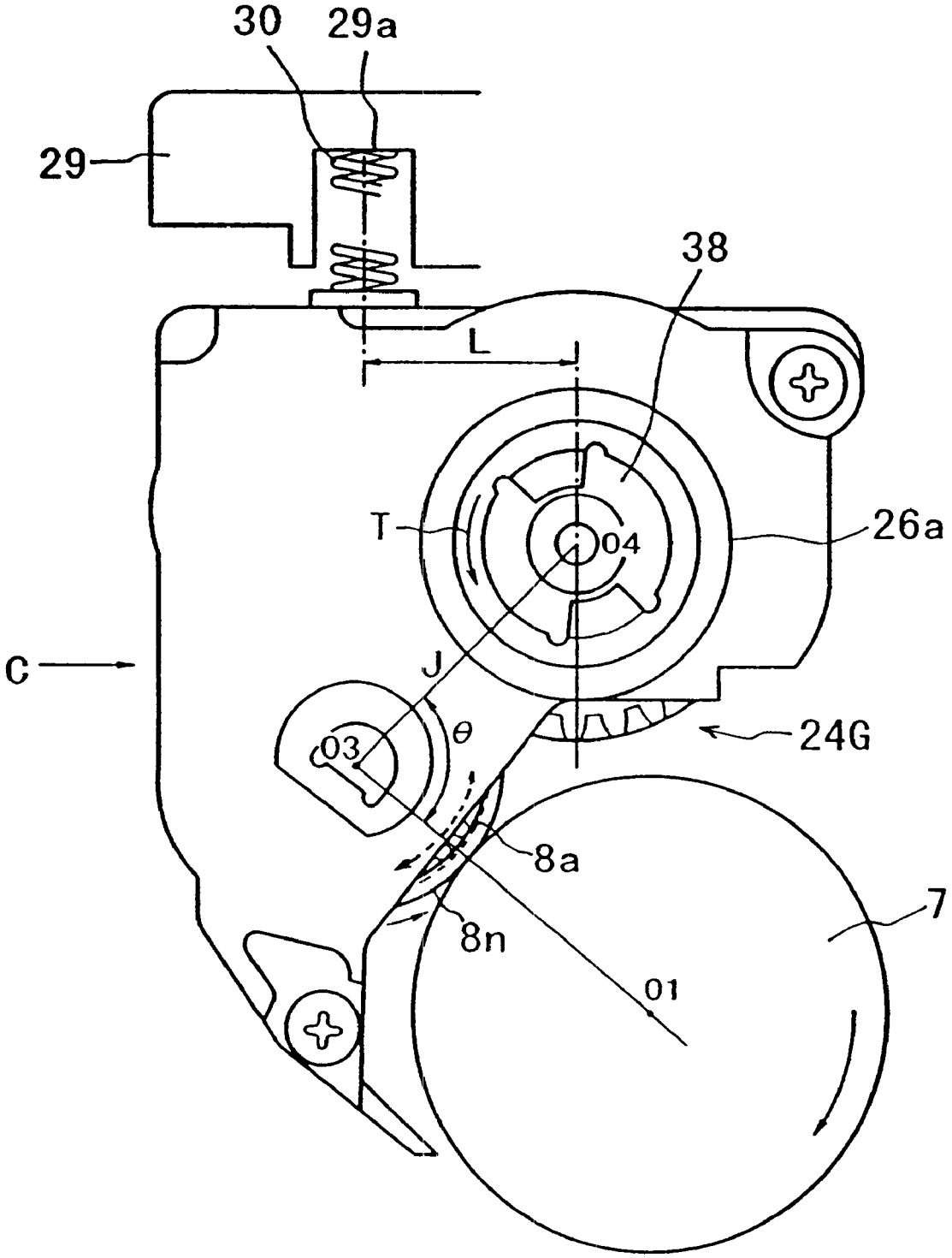
FIG. 32 is a rear view showing a relation of the driving force of the charging roller.

FIG. 32 shows a load relation when the rotating force is transmitted to the charging unit having the charging roller from the charge portion coupling.

There is provided a gap for magnetic brush charging between the photosensitive drum 7 and the charging roller 8*a* so that photosensitive drum 7 is electrically charged and that residual toner remaining on the photosensitive drum 7 after the image transfer is taken in the charging roller 8*a* and is discharged with the adjusted electric charge. In order to provide the gap, a spacer roller 8*n* the rotatably engaged with a journal portion 8*a*2 of the developing roller 8*a*. The radius of the spacer roller 8*n* is larger than the radius of the developing roller 8*a* by the gap between the developing roller 8*a* and the photosensitive drum 7. The spacer roller 8*n* is press contacted to the photosensitive drum 7 at the opposite sides of the charging region in the longitudinal direction of the photosensitive drum 7.

The photosensitive drum 7 and the charging roller 8*a* are rotated in the same direction, and therefore, the peripheral surfaces of the photosensitive drum 7 and the charging roller 8*a* move in the opposite directions in the charging region and at longitudinal opposite ends thereof.

The angle θ formed between a line connecting the center 01 of the photosensitive drum 7 and the center 03 of the charging roller 8*a* and a line connecting the center 03 of the charging roller 8*a* and the center 04 of the charge portion coupling 38 is substantially right angles. It will suffice if the torque T imparted to the charge portion coupling 38 from the coupling 67 of the driving unit of the main assembly 14 of the apparatus tends to press contact the charging roller 8*a* to the photosensitive drum 7, except for the range in which the charging roller 8*a* receives the force toward the photosensitive drum 7 by wedge effect as the angle approaches to 180°. In FIG. 32, the center 03 of the charging roller 8*a* is disposed in the left side area of a line connecting the center 04 of the charge portion coupling 38 and the center 01 of the photosensitive drum 7.

The torque T received by the charge portion coupling 38 causes the charging unit C to rotate in the couterclockwise direction about the centers of the cylindrical shaft portion 26*a* supporting the charging unit C and the hole 23*a* (FIG. 11). Then, a press-contact force T/J is produced between the spacer roller 8*n* of the charging roller 8*a* and the photosensitive drum 7 where J is a distance between the center 03 of the charging roller 8*a* and the charge portion coupling 04.

On the other hand, around the cylindrical shaft portion 26*a* and the hole 23*a*, torque Fs×L is produced where L is a distance between the center line of the compression coil spring 30 and the center 04 of the charge portion coupling 38, and Fs is a spring force of the compression coil spring 30, and therefore, a press-contact force Fs×L/J is produced between the spacer roller 8*n* of the charging roller 8*a* and the photosensitive drum 7 by the torque.

With this structure, even when the spring force of the compression coil spring 30 which urges the charging unit C, the press-contact force between the spacer roller 8*n* and the photosensitive drum 7 is enough. By doing so, the deformation of the spacer roller 8*n* due to creep which is caused by small press-contact force between the spacer roller 8*n* and the photosensitive drum 7 when the process cartridge B is not yet used.

(Cartridge Mounting Portion)

Figure 33:
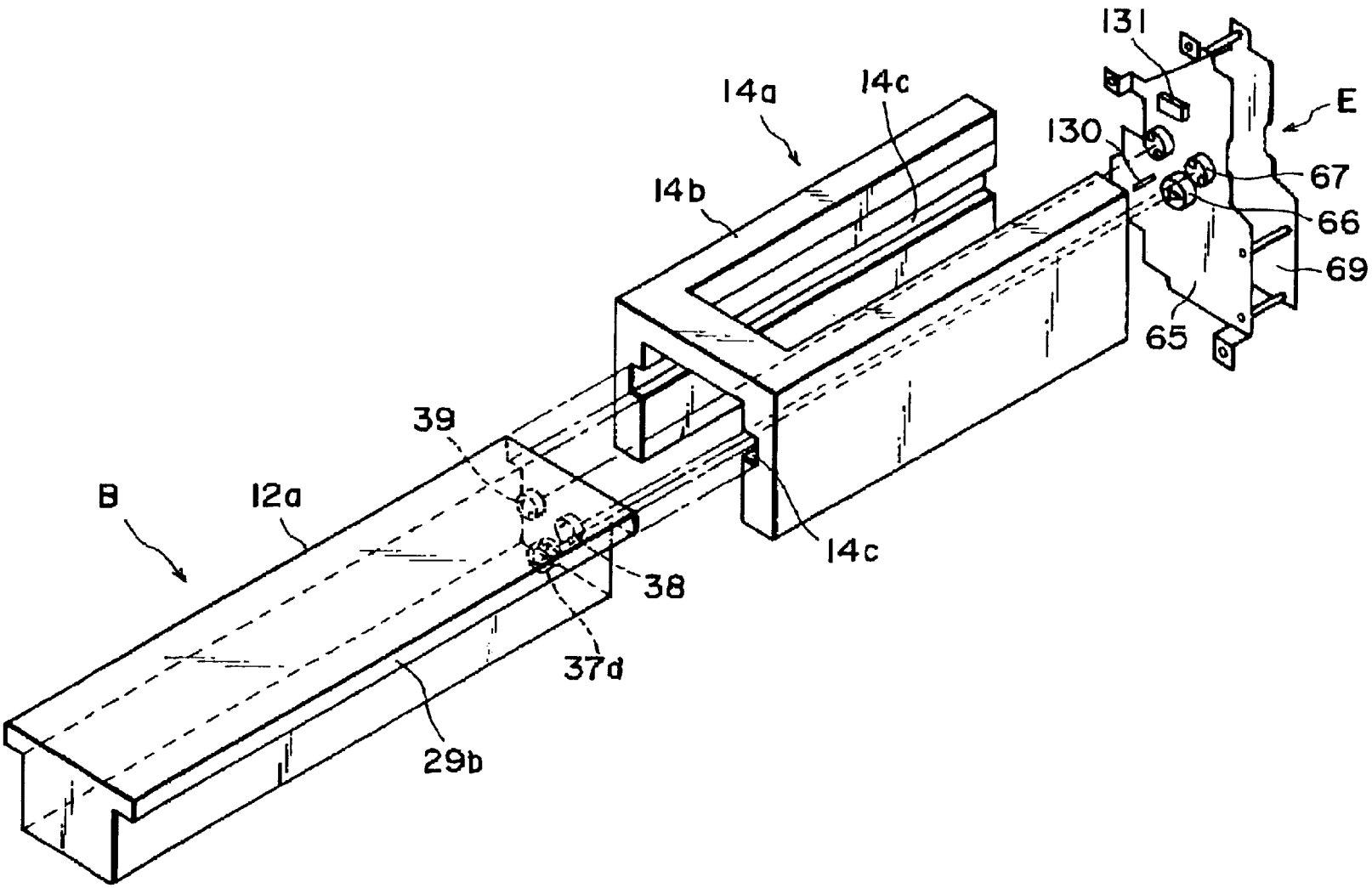
FIG. 33 is a perspective view of a cartridge mounting portion.

FIG. 33 shows one of cartridge mounting portions. In each of the image formation stations 31Y, 31M, 31C, 31BK of the main assembly 14 of the apparatus, are shown in FIG. 33, there is provided a cartridge mounting portion 14*a*. The cartridge mounting portion 14*a* is provided with a cartridge guide 14*b* and a driving unit E. The cartridge guide 14*b* has a guiding 14*c* extending perpendicularly to a feeding direction of the recording material 2 and parallel with the surface of the recording material 2. A guide portion 12*a*, 29*b* of the process cartridge B is engaged with the guiding 14*c*, and the process cartridge B is inserted to the cartridge mounting portion 14*a* or removed from the cartridge mounting portion 14*a*. When the process cartridge is inserted to the cartridge mounting portion 14*a*, as has been described hereinbefore, the drum coupling 37*d* (male coupling) of the process cartridge B, the charge portion coupling 38 and the developing means coupling 39 are engaged with the couplings 66, 67, 68 of the driving unit E.

The embodiment of the present invention are summarized as follows.

1. A process cartridge B detachably mountable to a main assembly 14 of an electrophotographic image forming apparatus, comprising:
   - an electrophotographic photosensitive member (photosensitive drum 7);
   - a photosensitive member driving force receiving portion (male coupling 37*d*) for receiving from the main assembly 14 of the apparatus a driving force for rotating the photosensitive member (photosensitive drum 7) when the process cartridge B is mounted to the main assembly 14 of the apparatus;
   - a developing member (developing roller 10*d*) for developing an electrostatic latent image formed on the photosensitive member (photosensitive drum 7);
   - a developing member (developing roller 10*d*) driving force receiving portion developing means coupling 39 for receiving from the main assembly 14 of the apparatus a driving force for rotating the developing member (developing roller 10*d*) when the process cartridge B is mounted to the main assembly 14 of the apparatus;

a developing bias contact 104 for receiving the main assembly 14 of the apparatus a developing bias for applying to the developing member (developing roller 10*d*) when the process cartridge B is mounted to the main assembly 14 of the apparatus;

a toner content detecting member 140 for detecting a mixing ratio of toner and carrier in developer to be used by the developing member (developing roller 10*d*) to develop the electrostatic latent image;

a connector portion 105 for transmitting a result of detection by the detecting member to the main assembly 14 of the apparatus by electrical connection to the main assembly 14 of the apparatus;

wherein the photosensitive member (photosensitive drum 7) driving force receiving portion, developing member (developing roller 10*d*) driving force receiving portion developing means coupling 39, developing bias contact 104 and connector portion 105 are disposed at a leading end X of the process cartridge B when the process cartridge B is mounted to the main assembly 14 of the apparatus, and the connector portion 105 and the developing bias contact 104 are disposed with the developing member (developing roller 10*d*) driving force receiving portion developing means coupling 39 therebetween, and wherein the process cartridge B is mounted to the main assembly 14 of the apparatus along a longitudinal direction X1 of the developing member (developing roller 10*d*).

2. A process cartridge B according to Paragraph 1, wherein the connector portion 105, the developing member (developing roller 10*d*) driving force receiving portion developing means coupling 39 and the developing bias contact 104 are arranged such that they are positioned in this order from a top side to a bottom side of the process cartridge B, when the process cartridge B is mounted to the main assembly 14 of the apparatus. (FIG. 2)

3. A process cartridge B according to Paragraph 1, 2, further comprising a charging member (charging roller 8*a*) for charging the photosensitive member (photosensitive drum 7), and a charging bias contact 103, at a leading end X of the process cartridge B when the process cartridge B is mounted to the main assembly 14 of the apparatus, for receiving from the main assembly 14 of the apparatus a charging bias voltage for applying to the charging member (charging roller 8*a*) when the process cartridge B is mounted to the main assembly 14 of the apparatus.

4. A process cartridge B according to Paragraph 3, further comprising an electroconductive brush 11 contacted to the photosensitive member (photosensitive drum 7), wherein at a leading end X of the process cartridge B when the process cartridge B is mounted to the main assembly 14 of the apparatus, there is provided an electroconductive brush 11 contact for receiving from the main assembly 14 of the apparatus a main assembly 14 voltage of a polarity opposite from the charging bias voltage for applying to the electroconductive brush 11 when the process cartridge B is mounted to the main assembly 14 of the apparatus.

5. A process cartridge B according to Paragraph 4, further comprising a grounding contact for electrically grounding the photosensitive member (photosensitive drum 7) when the process cartridge B is mounted to the main assembly 14 of the apparatus at a trailing end of the process cartridge B when the process cartridge B is mounted to the main assembly 14 of the apparatus.

6. A process cartridge B according to Paragraph 1, 2, 3 or 4, wherein the driving force receiving portion and developing member (developing roller 10*d*) driving force receiving portion developing means coupling 39 constitute a coupling.

7. A process cartridge B according to Paragraph 1, 2, 3 or 4, wherein the developing bias comprises a DC voltage and AC voltage components.

The developing means coupling 39 functioning as a developing means driving input portion, the developing bias contact 104 for supplying electric power to the developing sleeve 10*d* and the connector 105 for the toner content detecting means 140 for detecting the mixing ratio of the toner and the carrier in the developing unit D, are disposed at a leading side end portion of the process cartridge B with respect to the mounting direction relative to the main assembly 14 of the apparatus, by which he mounting property of the process cartridge B relative to the main assembly 14 of the apparatus is improved, so that drive transmission mechanism is simplified, and the connection of the connector and the connection of the developing bias contact are assured.

As for the main assembly of the apparatus, the wiring among the electrical parts are simplified because the driver, the connector and the contact are disposed on one end of the process cartridge.

In addition, since the developing bias contact 104 for supplying the electric power to the developing sleeve 10*d* and the connector 105 for the toner content detecting means 140 for detecting the mixing ratio of the toner and the carrier in the developing unit D are disposed with the developing means coupling 39 therebetween, by which the toner content controlling mechanism including the toner content detecting means 140 is free of influence of the high voltage AC voltage at the developing bias contact. In addition, by the above-described arrangement, the distances from the developing bias contact 104, toner content detecting means 140 to the developing means coupling 39 are small, and therefore, even if a small swinging occurs in the developing means coupling 30, the electrical connection between the main assembly and the developing bias contact 104 or the toner content detecting means 140 is not easily influenced.

The description has been made with respect to a process cartridge, but the present invention is applicable to a developing device which is detachably mountable to the main assembly of the apparatus and which contains as a unit a developing member and a developer.

As described in the foregoing, the mounting-and-demounting operativity of the process cartridge or the developing device relative to the main assembly of the apparatus is improved. Additionally, the connection of the connectors and the contact of the developing bias contacts are assured.

Furthermore, the possible influence of the high voltage AC voltage for he developing bias contact to the toner content detecting member of the toner content controlling mechanism can be avoided.

While the invention has been described with reference to the structures disclosed herein, it is not confined to the details set forth and this application is intended to cover such modifications or changes as may come within the purpose of the improvements or the scope of the following claims.

What is claimed is:

1. A process cartridge detachably mountable to a main assembly of an electrophotographic image forming apparatus, comprising:

an electrophotographic photosensitive member;

a photosensitive member driving force receiving portion for receiving from the main assembly of the apparatus a driving force for rotating said photosensitive member when said process cartridge is mounted to the main assembly of the apparatus;

a developing member for developing an electrostatic latent image formed on said photosensitive member;

a developing member driving force receiving portion for receiving from the main assembly of the apparatus a driving force for rotating said developing member when said process cartridge is mounted to the main assembly of the apparatus;

a developing bias contact for receiving from the main assembly of the apparatus a developing bias for applying to said developing member when said process cartridge is mounted to the main assembly of the apparatus;

a developer content detecting member for detecting a mixing ratio of toner and carrier in developer to be used by said developing member to develop the electrostatic latent image;

a connector portion for transmitting a result of detection by said detecting member to the main assembly of the apparatus by electrical connection to the main assembly of the apparatus;

wherein said photosensitive member driving force receiving portion, developing member driving force receiving portion, developing bias contact and connector portion are disposed at a leading end of said process cartridge when said process cartridge is mounted to the main assembly of the apparatus, and said connector portion and said developing bias contact are disposed with said developing member driving force receiving portion therebetween, and wherein said process cartridge is mounted to the main assembly of the apparatus along a longitudinal direction of said developing member.

2. A process cartridge according to claim 1, wherein said connector portion, said developing member driving force receiving portion and said developing bias contact are arranged such that they are positioned in this order from a top side to a bottom side of the process cartridge, when said process cartridge is mounted to the main assembly of the apparatus.

3. A process cartridge according to claim 1 or 2, further comprising a charging member for charging said photosensitive member, and a charging bias contact, at a leading end of said process cartridge when said process cartridge is mounted to the main assembly of the apparatus, for receiving from the main assembly of the apparatus a charging bias voltage for applying to said charging member when said process cartridge is mounted to the main assembly of the apparatus.

4. A process cartridge according to claim 3, further comprising an electroconductive brush contacted to said photosensitive member, wherein at a leading end of said process cartridge when said process cartridge is mounted to the main assembly of the apparatus, there is provided an electroconductive brush contact for receiving from the main assembly of the apparatus a main assembly voltage of a polarity opposite from the charging bias voltage for applying to said electroconductive brush when said process cartridge is mounted to the main assembly of the apparatus.

5. A process cartridge according to claim 4, further comprising a grounding contact for electrically grounding said photosensitive member when said process cartridge is mounted to the main assembly of the apparatus at a trailing end of said process cartridge when said process cartridge is mounted to the main assembly of the apparatus.

6. A process cartridge according to claim 1, wherein said photosensitive member driving force receiving portion and developing member driving force receiving portion constitute a coupling.

7. A process cartridge according to claim 1, wherein said developing bias comprises a DC voltage and AC voltage components.

8. A process cartridge detachably mountable to a main assembly of an electrophotographic image forming apparatus, comprising:

an electrophotographic photosensitive drum;

a photosensitive drum coupling for receiving from the main assembly of the apparatus a driving force for rotating said photosensitive drum when said process cartridge is mounted to the main assembly of the apparatus;

a developing roller for developing an electrostatic latent image formed on said photosensitive drum;

a developing roller coupling for receiving from the main assembly of the apparatus a driving force for rotating said developing roller when said process cartridge is mounted to the main assembly of the apparatus;

a developing bias contact for receiving from the main assembly of the apparatus a developing bias for applying to said developing roller when said process cartridge is mounted to the main assembly of the apparatus;

a charging member for charging said photosensitive drum;

a charging bias contact for receiving from the main assembly of the apparatus a charging bias for applying to said charging member when said process cartridge is mounted to the main assembly of the apparatus;

an electroconductive brush contacted to said photosensitive drum;

an electroconductive brush contact for receiving from the main assembly of the apparatus a bias voltage having a polarity opposite from the charging bias for applying to the electroconductive brush when said process cartridge is mounted to the main assembly of the apparatus;

a developer content detecting member for detecting a mixing ratio of toner and carrier in developer to be used by said developing roller to develop the electrostatic latent image;

a connector portion for transmitting a result of detection by said detecting member to the main assembly of the apparatus by electrical connection to the main assembly of the apparatus;

a grounding contact for electrically grounding said photosensitive drum when said process cartridge is mounted to the main assembly of the apparatus;

wherein said photosensitive drum coupling, developing roller coupling, developing bias contact, charging bias contact, electroconductive brush contact and connector portion are disposed at a leading end of said process cartridge when said process cartridge is mounted to the main assembly of the apparatus, and said grounding contact is disposed at a trailing end of said process cartridge when said process cartridge is mounted to the main assembly of the apparatus, wherein said connector portion, said developing roller coupling and said developing bias contact are arranged such that they are positioned in this order from a top side to a bottom side of the process cartridge, when said process cartridge is mounted to the main assembly of the apparatus, and wherein said process cartridge is mounted to the main assembly of the apparatus along a longitudinal direction of said developing roller.

9. A process cartridge according to claim 8, wherein said developing bias comprises a DC voltage and AC voltage components.

10. A developing device detachably mountable to a main assembly of an electrophotographic image forming apparatus, comprising:

a developing member for developing an electrostatic latent image formed on an electrophotographic photosensitive member;

a developing member driving force receiving portion for receiving from the main assembly of the apparatus a driving force for rotating said developing member when said developing device is mounted to the main assembly of the apparatus;

a developing bias contact for receiving from the main assembly of the apparatus a developing bias voltage for applying the developing member when said developing device is mounted to the main assembly of the apparatus;

a developer content detecting member for detecting a mixing ratio of toner and carrier in developer to be used for developing the electrostatic latent image by said developing member;

a connector portion for transmitting a result of detection by said detecting member to the main assembly of the apparatus by electrical connection to the main assembly of the apparatus;

wherein developing member driving force receiving portion, developing bias contact and connector portion are disposed at a leading end of said developing device when said developing device is mounted to the main assembly of the apparatus, and said connector portion and said developing bias contact are disposed with said developing member driving force receiving portion therebetween, and wherein said developing device is mounted to the main assembly of the apparatus along a longitudinal direction of said developing roller.

11. A developing device according to claim 10, wherein said connector portion, said developing member coupling and said developing bias contact are arranged such that they are positioned in this order from a top side to a bottom side of said developing device, when said developing device is mounted to the main assembly of the apparatus.

12. A developing device according to claim 10 or 11, wherein said developing bias comprises a DC voltage and, AC voltage components.

13. An electrophotographic image forming apparatus for forming an image on a recording material, to which a process cartridge is detachably mountable, said apparatus comprising:

(a) a photosensitive member driving force transmitting portion;

(b) a developing member driving force transmitting portion;

(c) a mounting portion for mounting the process cartridge, said process cartridge including:

electrophotographic photosensitive member;

a photosensitive member driving force receiving portion for receiving from said photosensitive member driving force transmitting portion a driving force for rotating said photosensitive member when said process cartridge is mounted to the main assembly of the apparatus;

a developing member for developing an electrostatic latent image formed on said photosensitive member;

a developing member driving force receiving portion for receiving from said developing member driving force transmitting portion a driving force for rotating said developing member when said process cartridge is mounted to the main assembly of the apparatus;

a developing bias contact for receiving from the main assembly of the apparatus a developing bias for applying to said developing member when said process cartridge is mounted to the main assembly of the apparatus;

a developer content detecting member for detecting a mixing ratio of toner and carrier in developer to be used by said developing member to develop the electrostatic latent image;

a connector portion for transmitting a result of detection by said detecting member to the main assembly of the apparatus by electrical connection to the main assembly of the apparatus;

wherein said photosensitive member driving force receiving portion, developing member driving force receiving portion, developing bias contact and connector portion are disposed at a leading end of said process cartridge when said process cartridge is mounted to the main assembly of the apparatus, and said connector portion and said developing bias contact are disposed with said developing member driving force receiving portion therebetween, and wherein said process cartridge is mounted to the main assembly of the apparatus along a longitudinal direction of said developing member.

14. An electrophotographic image forming apparatus for forming an image on a recording material, to which a process cartridge is detachably mountable, said apparatus comprising:

(a) a photosensitive drum driving force transmitting portion;

(b) a developing member driving force transmitting portion;

(c) a mounting portion for mounting the process cartridge, said process cartridge including:

an electrophotographic photosensitive drum;

a photosensitive drum coupling for receiving from said photosensitive drum driving force transmitting portion a driving force for rotating said photosensitive drum when said process cartridge is mounted to the main assembly of the apparatus;

a developing roller for developing an electrostatic latent image formed on said photosensitive drum;

a developing roller coupling for receiving from said developing member driving force transmitting portion a driving force for rotating said developing roller when said process cartridge is mounted to the main assembly of the apparatus;

a developing bias contact for receiving from the main assembly of the apparatus a developing bias for applying to said developing roller when said process cartridge is mounted to the main assembly of the apparatus;

a charging member for charging said photosensitive drum;

a charging bias contact for receiving from the main assembly of the apparatus a charging bias for applying to said charging member when said process cartridge is mounted to the main assembly of the apparatus;

an electroconductive brush contacted to said photosensitive drum;

an electroconductive brush contact for receiving from the main assembly of the apparatus a bias voltage having a polarity opposite from the charging bias for applying to the electroconductive brush when said process cartridge is mounted to the main assembly of the apparatus;

a developer content detecting member for detecting a mixing ratio of toner and carrier in developer to be used by said developing roller to develop the electrostatic latent image;

a connector portion for transmitting a result of detection by said detecting member to the main assembly of the apparatus by electrical connection to the main assembly of the apparatus;

a grounding contact for electrically grounding said photosensitive drum when said process cartridge is mounted to the main assembly of the apparatus;

wherein said photosensitive drum coupling, developing roller coupling, developing bias contact, charging bias contact, electroconductive brush contact and connector portion are disposed at a leading end of said process cartridge when said process cartridge is mounted to the main assembly of the apparatus, and said grounding contact is disposed at a trailing end of said process cartridge when said process cartridge is mounted to the main assembly of the apparatus, wherein said connector portion, said developing roller coupling and said developing bias contact are arranged such that they are positioned in this order from a top side to a bottom side of the process cartridge, when said process cartridge is mounted to the main assembly of the apparatus, and wherein said process cartridge is mounted to the main assembly of the apparatus along a longitudinal direction of said developing roller.

15. An electrophotographic image forming apparatus for forming an image on a recording material, to which a developing device is detachably mountable, said apparatus comprising:

(a) a developing member driving force transmitting portion;

(b) a mounting portion for mounting said developing device, said developing device including:

a developing member for developing an electrostatic latent image formed on an electrophotographic photosensitive member;

a developing member driving force receiving portion for receiving from said developing member driving force transmitting portion a driving force for rotating said developing member when said developing device is mounted to the main assembly of the apparatus;

a developing bias contact for receiving from the main assembly of the apparatus a developing bias voltage for applying the developing member when said developing device is mounted to the main assembly of the apparatus;

a developer content detecting member for detecting a mixing ratio of toner and carrier in developer to be used for developing the electrostatic latent image by said developing member;

a connector portion for transmitting a result of detection by said detecting member to the main assembly of the apparatus by electrical connection to the main assembly of the apparatus;

wherein said developing member driving force receiving portion, developing bias contact and connector portion are disposed at a leading end of said developing device when said developing device is mounted to the main assembly of the apparatus, and said connector portion and said developing bias contact are disposed with said developing member driving force receiving portion therebetween, and wherein said developing device is mounted to the main assembly of the apparatus along a longitudinal direction of said developing member.

* * * * *

UNITED STATES PATENT AND TRADEMARK OFFICE

CERTIFICATE OF CORRECTION

PATENT NO. : 6,389,250 B1
DATED : May 14, 2002
INVENTOR(S) : Atsushi Numagami et al.

It is certified that error appears in the above-identified patent and that said Letters Patent is hereby corrected as shown below:

Column 6,
Line 55, “transfer” should read -- transferred --.

Column 7,
Line 22, “drum” should read -- drum 7 --.

Column 8,
Line 19, “screwed.” should read -- screws. --.

Column 11,
Line 63, “52,” should read -- 52. --.

Column 12,
Line 15, “most to” should be deleted; and
Line 20, “As shown in Figure, a” should read -- A --.

Column 13,
Line 15, “mashing” should read -- meshing --.

Column 17,
Line 11, “he” should read -- the --.

Column 20,
Line 63, “of the” should be deleted.

UNITED STATES PATENT AND TRADEMARK OFFICE

CERTIFICATE OF CORRECTION

PATENT NO. : 6,389,250 B1
DATED : May 14, 2002
INVENTOR(S) : Atsushi Numagami et al.

It is certified that error appears in the above-identified patent and that said Letters Patent is hereby corrected as shown below:

Column 24,
Line 23, “he” should read -- the --; and
Line 60, “he” should read -- the --.

Signed and Sealed this

Tenth Day of September, 2002

*Attest:*

*Attesting Officer*

JAMES E. ROGAN
*Director of the United States Patent and Trademark Office*